US005655188A

United States Patent [19]

Nagamori et al.

[11] Patent Number: 5,655,188

[45] Date of Patent: Aug. 5, 1997

[54] CHARGING DEVICE AND IMAGE FORMING APPPARATUS

[75] Inventors: Yuki Nagamori; Tsutomu Sugimoto, both of Nakai-machi; Yoshitaka Kuroda, Ebina, all of Japan

[73] Assignee: Fuji Xerox Co., Ltd., Tokyo, Japan

[21] Appl. No.: 551,919

[22] Filed: Oct. 23, 1995

[30] Foreign Application Priority Data

Mar. 2, 1995 [JP] Japan ..... 7-066652

[51] Int. Cl.[6] ..... G03G 15/02

[52] U.S. Cl. ..... 399/174; 361/225

[58] Field of Search ..... 355/219; 361/221, 361/225; 399/168, 174, 176

[56] References Cited

U.S. PATENT DOCUMENTS

| | | | |
|---|---|---|---|
| 4,380,384 | 4/1983 | Ueno et al. | 355/219 |
| 4,791,882 | 12/1988 | Enoguchi et al. | 118/653 |
| 5,243,387 | 9/1993 | Ikegawa | 355/219 |

FOREIGN PATENT DOCUMENTS

| | | |
|---|---|---|
| 1-93760 | 4/1989 | Japan . |
| 3-203754 | 9/1991 | Japan . |
| 4-232977 | 8/1992 | Japan . |
| 4-249270 | 9/1992 | Japan . |
| 5-72869 | 3/1993 | Japan . |

*Primary Examiner*—William J. Royer
*Attorney, Agent, or Firm*—Oliff & Berridge

[57] ABSTRACT

A charging device includes a substantially cylindrical charging electrode formed by rolling a flexible, semiconductive film, an electrode support member inserted in the substantially cylindrical charging electrode to support the charging electrode so as to be in contact with the turning surface of a charge acceptor, and a voltage applying means for applying a charging voltage to the charging electrode. The electrode support member is held with a gap between the electrode support member and the charge acceptor so that the charging electrode can be turned by an electrostatic force acting between the charging electrode and the charge acceptor. When a charging voltage is applied to the charging electrode, the charging electrode is pulled toward the charge acceptor by an electrostatic force acting between the charging electrode and the charge acceptor. Since the charging electrode is pulled for turning by the charge acceptor, the discharge region in which an appropriate gap is formed is expanded, whereby the charge acceptor can be satisfactorily charged in a stable potential distribution. The charging device may be provided with an electrode stabilizing member in contact with the charging member to stabilize the turning motion of the charging electrode and to hold the charging electrode in stable contact with the charge acceptor.

19 Claims, 19 Drawing Sheets

CHARGING DEVICE AND IMAGE FORMING APPPARATUS

BACKGROUND OF THE INVENTION

1. Field of the Invention

The present invention relates to a charging device for uniformly charging the surface of a photoconductive body, i.e., a charge acceptor, and an electrophotographic image forming apparatus provided with this charging device and, more particularly, a charging device to be disposed with its charging electrode in contact with the surface of a photoconductive body, and an electrophotographic image forming apparatus provided with this charging device.

2. Description of the Related Art

An image forming apparatus, such as a copying machine or a printer, charges the surface of a photoconductive body, i.e., a charge acceptor, by a charging device, forms an electrostatic latent image on the surface of the photoconductive body by irradiating the surface of the photoconductive body with imaging light, and develops the electrostatic latent image in a visible image by applying a developer to the electrostatic latent image. Some conventional charging devices of a corona charging system for use on such an electrophotographic image forming apparatus use corona discharge and others of a contact charging system use a charging roller or the like.

A charging device of a corona discharge system has a discharge wire extended near the surface of a charge acceptor in a shield case, applies a high voltage across the discharge wire to initiate a corona discharge to charge the surface of the charge acceptor with a predetermined charge. Although this known charging device exerts an excellent performance in uniformly charging the charge acceptor, the discharge device produces a large amount of discharge products, such as ozone, needs to remove the discharge products, which, in most cases, increases the size and the cost of the discharge device.

Accordingly, a discharge device of a contact charging system provided with a charging electrode to be disposed in direct contact with a charge acceptor has been used. The charging device of a contact charging system has a conductive charging member, such as an elastic, conductive charging roller or a conductive charging brush, disposed in contact with the surface of a charge acceptor, and applies a charging voltage across the conductive charging member to pass an electrical discharge across a minute gap near the position where the conductive charging member is in contact with the surface of the charge acceptor to charge the charge acceptor. Charging devices disclosed in Japanese Patent Laid-open Nos. Hei 1-93760 and Hei 3-203754 employ a blade-like charging electrode pressed against the surface of a charge acceptor to use the charging electrode also as a cleaning blade for removing residual toner from the surface of the charge acceptor. A charging device disclosed in Japanese Patent Laid-open No. Hei 4-249270 employs a flexible film as a charging electrode, disposes the flexible film with its working edge in contact with the surface of a charge acceptor.

These known charging devices produce only a very small amount of ozone because they do not use corona discharge, and can be formed in a small, lightweight construction because the conductive charging member is disposed in contact with the charge acceptor.

The charging device of a contact charging system employing a conductive charging roller needs a supporting mechanism for supporting the charging roller, and hence, in most cases, has a complex construction. The elastic charging roller must be in close contact with the charge acceptor so that a stable minute gap is formed to charge the charge acceptor uniformly, and hence, the hardness of a rubber coating forming the surface of the elastic charging roller must be comparatively low. Such a rubber coating contains a comparatively large amount of process oil and hence the process oil is liable to be transferred to the charge acceptor to affect image quality adversely. A means for overcoming such a disadvantage of the charging roller finishes the charging roller in a higher dimensional accuracy. However, it is very difficult to finish a charging roller provided with a rubber coating in a high dimensional accuracy, so that the yield of the charging roller manufacturing process is reduced entailing increase in the cost.

The charging device employing a conductive brush is advantageous, as compared with the charging device employing the charging roller, in placing the charging member in uniform contact with the charge acceptor because the conductive brush can be easily disposed so as to be in uniform contact with the charge acceptor. However, the charging brush needs much time and labor to manufacture and is liable to form brush marks that cause irregular charging adversely affecting the image.

The blade-like charging member which is used also as a cleaning blade is difficult to dispose properly so that the charging member is able to remove the residual toner satisfactorily and to form a minute gap necessary for discharge accurately. Therefore, it is difficult to charge the charge acceptor uniformly and satisfactorily by using the blade-like charging member.

The film-shaped charging electrode, as compared with other conductive charging members, is simple in construction, is easy to dispose in stable contact with the charge acceptor and can be manufactured at a low manufacturing cost. However, the film-shaped charging electrode vibrates due to frictional electrification because the working edge of the film-shaped charging electrode is in contact with the charge acceptor, whereby the charging potential is liable to be caused to become unstable. Furthermore, if foreign matters, such as toner and additives, adhere to the working edge of the film-like charging electrode, creeping discharge occurs to cause defective stripes of charges. A method to solve such a problem applies both a DC voltage and an AC voltage simultaneously to the film-shaped charging electrode. However, the AC voltage generates vibrations resonant with the frequency of the AC voltage and generates charging noise.

A charging device proposed in Japanese Patent Laid-open No. Hei 4-232977 or Hei 5-72869 to eliminate those disadvantages employs a cylindrical charging electrode formed by rolling a flexible film in a cylindrical shape, and supports the cylindrical charging electrode in contact with the circumference of a support roller so that the cylindrical charging electrode is in contact with a charge acceptor in a partly collapsed shape. The circumference of the charging electrode moves like an endless belt in the circumferential direction of movement of the charge acceptor as the support roller is driven for rotation. The charging electrode may be pressed against the circumference of the support roller to keep the charging roller in steady contact with the support roller. Since the charging electrode rotates at the same surface speed equal to that of the charge acceptor, the charging electrode and the charge acceptor are not frictionally electrified, faulty charging can be prevented, foreign matters, such as toner and the like, adhere scarcely to the charging electrode, irregularity in charge distribution on the circumference of the charge acceptor is reduced and, even if foreign matters adhere to the charging electrode, the formation of stripe-shaped defects in the image can be avoided because the charging electrode rotates.

This charging electrode, however, must be formed of a film of a small thickness, as compared with that of the film employed in the charging device disclosed in Japanese Patent Laid-open No. Hei 4-249270, to secure uniform contact between the charging electrode and the charge acceptor. Therefore, the charging electrode is liable to be deformed and, consequently, the charging electrode is strained by an excessively large force acting on a portion of the charging electrode in contact with the support roller, and the charging roller is wrinkled, dislocated and twisted in a long period of use.

When the charging electrode is pressed in close contact with the circumference of the support roller by a pressing member, a frictional force exerted by the pressing member on the charging electrode distorts the charging electrode, which is liable to form an irregular distribution of contact pressure between the charging electrode and the charge acceptor. Consequently, a uniform potential distribution of charges cannot be stably maintained. Furthermore, it is difficult to drive the support roller and the charge acceptor synchronously at the same surface speed and hence the frictional electrification of the charging electrode and the charge acceptor cannot be perfectly prevented.

SUMMARY OF THE INVENTION

The present invention has been made in view of those problems in the prior art and it is therefore an object of the present invention to provide a charging device that prevents the irregular turning of a charging electrode due to deformation attributable to wrinkling, dislocation and twisting, and secures a uniform, stable potential distribution of charges.

In a first aspect of the present invention, a charging device comprises a cylindrical charging electrode formed by rolling a flexible semiconductive film in a substantially cylindrical shape, an electrode support member inserted in the cylindrical charging electrode to support the cylindrical charging electrode so as to be in contact with a rotating charge acceptor, and a power supply for applying a charging voltage to the charging electrode. The electrode support member is held with a space between the electrode support member and the charge acceptor so that the charging electrode is turned by an electrostatic force acting between the charge acceptor and the charging electrode.

In a second aspect of the present invention, in the charging device in the first aspect of the present invention, an electrode stabilizing member is disposed in contact with the outer circumference of the charging electrode.

In a third aspect of the present invention, in the charging device in the second aspect of the present invention, the electrode stabilizing member is formed of a conductive material, and a charging voltage is applied through the electrode stabilizing member to the charging electrode.

In a fourth aspect of the present invention, in the charging device in the second or the third aspect of the present invention, the electrode stabilizing member is formed in a shape capable of applying an increased pressure to the opposite side portions of the charging electrode.

In a fifth aspect of the present invention, an image forming apparatus provided with the charging device in any one of the first to the fourth aspect of the present invention comprises a static eliminating device disposed before the charging device with respect to the direction of movement of the circumference of the charge acceptor to eliminate static charges in the middle portion of the charge acceptor with respect to a direction along the width excluding portions of the charge acceptor in contact with the opposite side portions of the charging electrode.

In the first aspect of the present invention, the electrode support member may be of any suitable shape provided that the electrode support member is able to keep the charging electrode in stable contact with the charge acceptor. Desirably, the charging electrode is formed of a material that produces only a small friction between the charging electrode and the charge acceptor. The electrode support member is formed of a conductive material and a charging voltage may be applied through the electrode support member to the charging electrode.

In the second aspect of the present invention, the electrode stabilizing member may be formed in any shape, in any construction and of any material provided that the electrode stabilizing member is able to be in uniform contact with the charging electrode with respect to a direction along the width. For example, the electrode stabilizing member may be a roller or a plate formed of foam polyurethane, silicone sponge, felt or a brush, a sheet of film, a blade, a rubber roller or a spring plate. In view of soft contact, a foam plastic, plastic sponge and a brush are desirable materials for forming the electrode stabilizing member.

In the fifth aspect of the present invention, the static eliminating device may be of any static eliminating system provided that the width, i.e., the size along a direction perpendicular to the moving direction of the circumference of the charge acceptor, of a working portion for eliminating charges of the charge acceptor is smaller than the width of the charge acceptor. For example, the static eliminating device is a static eliminating lamp unit or a static eliminating blade.

The charging device in the first aspect of the present invention has the substantially cylindrical charging electrode formed by rolling a semiconductive film, and the electrode support member held in the charging electrode and spaced from the charge acceptor. When a charging voltage is applied to the charging electrode, the inner surface of the charging electrode is held in contact with the electrode support member by an electrostatic force acting between the charging electrode and the electrode support member, and the charging electrode is pulled toward the charge acceptor by an electrostatic force acting between the charging electrode and the charge acceptor. The charge acceptor is driven for rotation in a fixed direction and the charging electrode supported on the electrode support member is driven for turning by the charge acceptor. Then, the charging electrode is pulled in the rotating direction of the charge acceptor, so that a fixed contact pressure is produced between the charging electrode and the charge acceptor. Consequently, the charging electrode is able to charge the charge acceptor stably and the charge acceptor can be charged in a uniform potential distribution. Since the charging electrode is pulled by the charge acceptor, the discharge region in which an appropriate gap is formed is expanded, whereby the charge acceptor can be satisfactorily charge in a stable potential distribution.

The charging device in the second aspect of the present invention is provided with the electrode stabilizing member. Therefore, the charging electrode is pushed toward the charge acceptor and is restrained from excessive deformation by a centrifugal force or the like. Accordingly, the charging electrode can be driven for stable turning by the electrostatic force acting between the charging electrode and the charge acceptor and the charging electrode can be uniformly pressed against the charge acceptor, so that the charge acceptor can be charged in a uniform potential distribution for an extended period of time.

In the charging device in the third aspect of the present invention, the electrode stabilizing member is formed of a conductive material and a charging voltage is applied through the electrode stabilizing member to the charging electrode. Therefore, the electrode support member need not be formed of a conductive material, such as a material containing carbon powder or the like, the electrode support member can be formed of a material selected from a variety of materials. Thus, the electrode support member can be formed of a material that further reduces the frictional force acting between the electrode support member and the charging electrode so that the discharge electrode is able to turn more smoothly; consequently the charge acceptor can be charged in a further stable potential distribution.

In the discharge device in the fourth aspect of the present invention, the portions of the electrode stabilizing member in contact with the opposite side portions of the charging electrode are formed to apply an increased pressure to the corresponding portions of the charging electrode. Therefore, the portions of the charging electrode will not separate from the charge acceptor and will not be excessively deformed when the charging electrode is turned. The opposite side portion portions of the charging electrode are caused to separate from the charge acceptor by the following causes. A static eliminating means is disposed before the charging device with respect to the moving direction of the surface of the charge acceptor to stabilize the potential distribution on the charge acceptor by leveling the potential distribution on the charge acceptor before the charge acceptor is charged by the charging device. When charges remaining on the charge acceptor before the charge acceptor is charged by the charging device are removed, the electrostatic force acting between the charging electrode and the charge acceptor increases. Consequently, the charging electrode formed by rolling a film is deformed greatly. The opposite side portions of the charging electrode, in which the internal force to maintain the opposite side portions in a cylindrical shape is smaller than that in the middle portion of the charging electrode, are deformed more greatly than the middle portion and, consequently, the charging electrode cannot be held in satisfactory contact with the charge acceptor.

The electrode stabilizing member applies an increased pressure greater than that applied to the middle portion of the charging electrode to the opposite side portions of the charging electrode. Therefore, the easily deformable opposite side portions can be pressed in uniform contact with the charge acceptor with respect to the axial direction, so that the charge acceptor can be charged in a uniform potential distribution. Consequently, images having foggy defects in portions near the side edges of sheets will not be formed and satisfactory images free from defects can be formed for a long period of image forming operation.

The image forming apparatus in the fifth aspect of the present invention is provided with a static eliminating device for removing static charges in the middle portion of the charge acceptor with respect to the width other than the opposite side portions in contact with the opposite side portions of the charging electrode. Therefore, only the charges in the middle portion of the charge acceptor are removed as the surface moves past a position corresponding to the static eliminating device, and charges remain on the opposite side portions of the charge acceptor. When the middle portion of the charge acceptor passes a position corresponding to the charging electrode, an increased electrostatic force acts between the charging electrode and the middle portion of the charge acceptor and a reduced electrostatic force acts between the charging electrode and the opposite side portions of the charge acceptor. Consequently, the middle portion of the charging electrode is pulled toward the charge acceptor by a greater force while the opposite side portions of the charging electrode are pulled toward the charge acceptor by a smaller force, so that the large deformation of the opposite side portions of the charging electrode can be avoided. Thus, the charge acceptor can be uniformly charged in a stable potential distribution and thereby the formation of foggy defects in portions of the image near the opposite side edges of the sheet can be prevented.

BRIEF DESCRIPTION OF THE DRAWINGS

The above and other objects, features and advantages of the present invention will become more apparent from the following description taken in connection with the accompanying drawing, in which.

DETAILED DESCRIPTION OF THE PREFERRED EMBODIMENTS

Figure 1A:
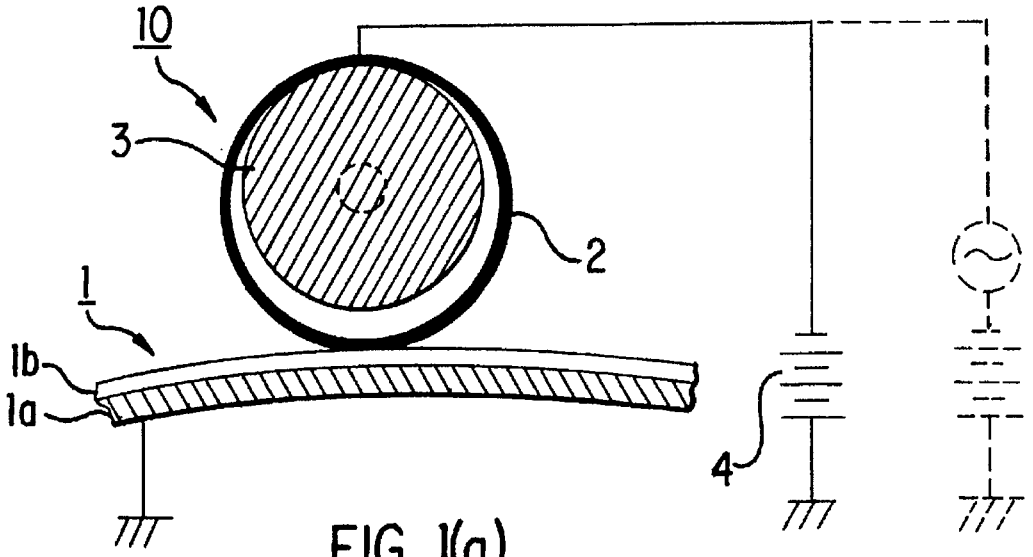
FIGS. 1(*a*) and 1(*b*) are a schematic sectional view and a schematic side view, respectively, of a charging device in a first embodiment according to the present invention.
Figure 1B:
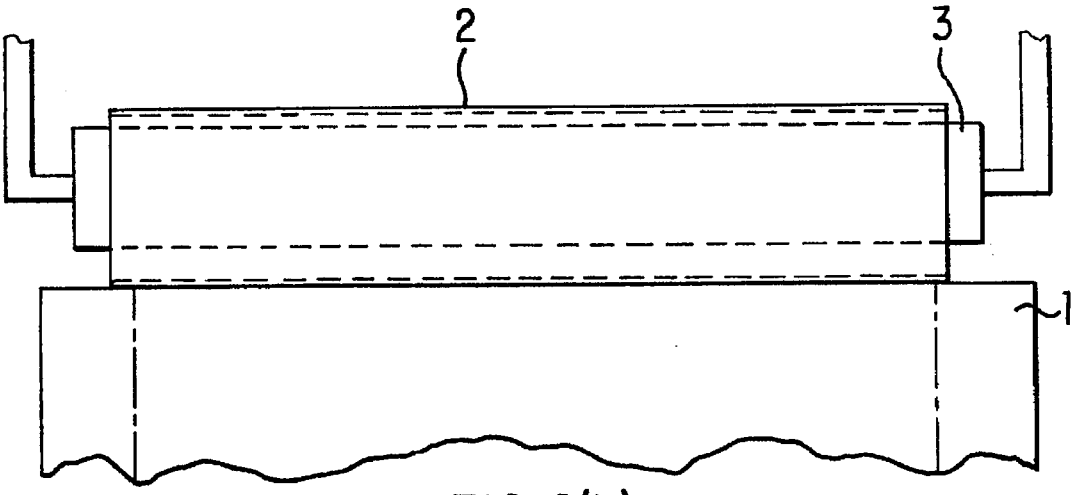

Referring to FIGS. 1(*a*) and 1(*b*), a charging device 10 in a first embodiment according to the present invention comprises a cylindrical charging electrode 2 formed by rolling a semiconductive film in a cylindrical shape, having an endless outer surface and supported for turning opposite to a charge acceptor 1 having a circumference that move in a fixed direction, and a cylindrical electrode support member 3 inserted in the charging electrode 2 so as to support the charging electrode 2 in contact with the charge acceptor 1. The electrode support member 3 is connected to a power supply 4 to apply a charging voltage therethrough to the charging electrode 2.

The charge acceptor 1 is constructed by forming a photoconductive layer 1*b* on the outer circumference of a conductive cylinder 1*a*. The conductive cylinder 1*a* is electrically grounded. The surface of the charge acceptor 1 is charged by producing discharge across a minute gap formed near the contact line between the charge acceptor 1 and the charging electrode 2. The circumference of the charging electrode 2 is longer than that of the electrode support member 3.

Figure 2A:
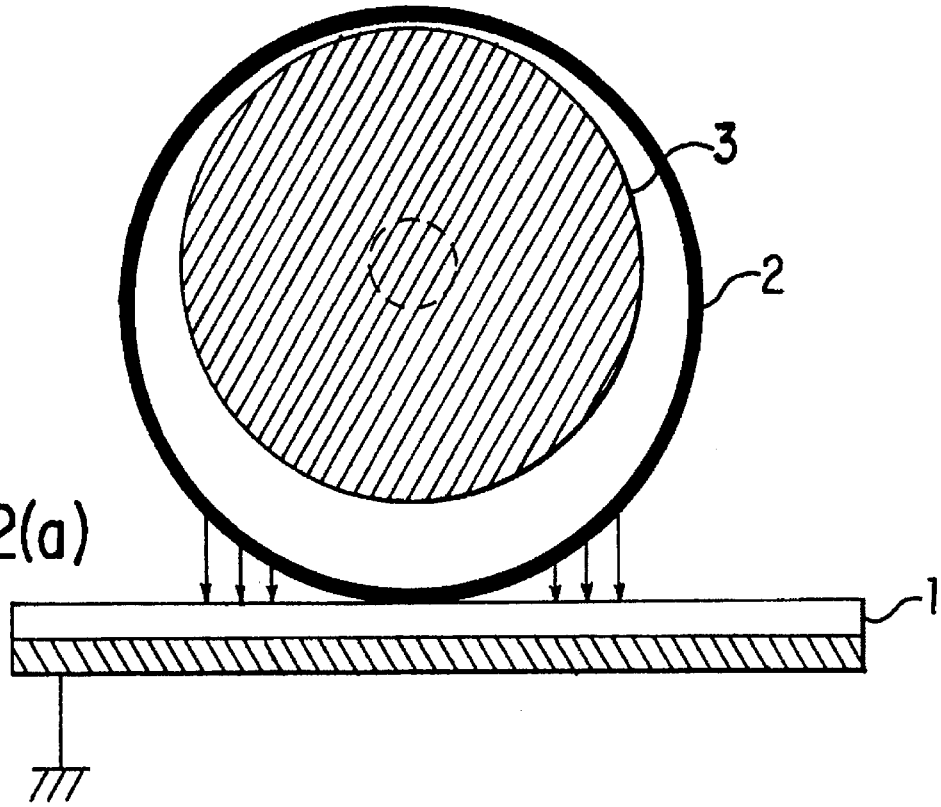
FIGS. 2(*a*) and 2(*b*) are sectional views of assistance in explaining the operation of the charging device of FIGS. 1(*a*) and 1(*b*)
Figure 2B:
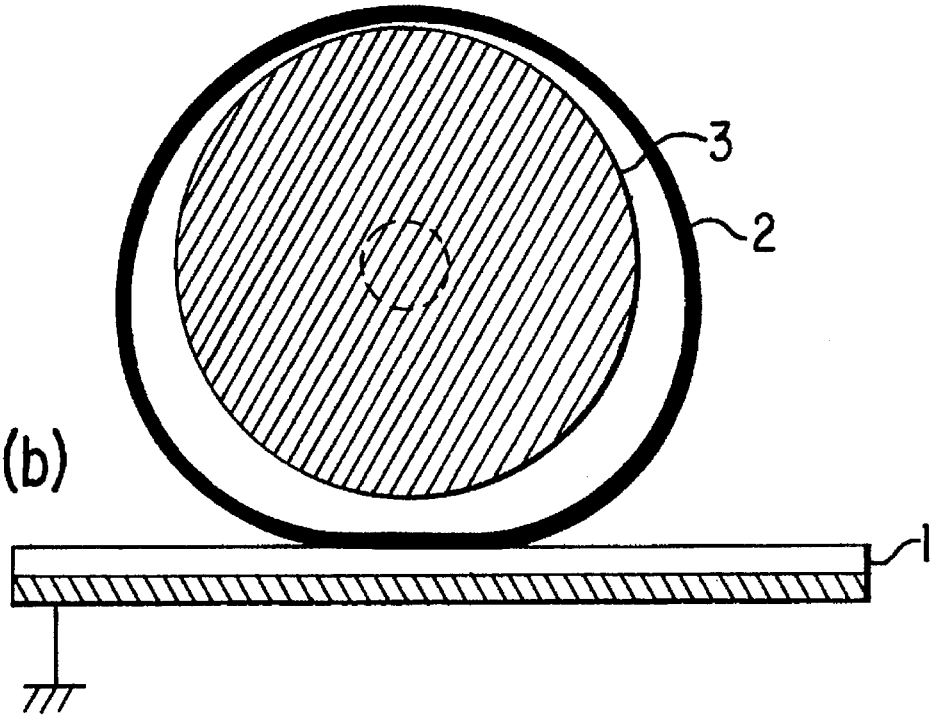

When no voltage is applied to the charging electrode 2, the charging electrode 2 is separated from the electrode support member 3 and rests on the charge acceptor 1 as shown in FIG. 2(*a*). When a charging voltage is applied to the charging electrode 2, the charging electrode 2 is attracted to the electrode support member 3 by an electrostatic force acting between the charging electrode 2 and the electrode support member 3 so that part of the inner circumference of the charging electrode 2 is in contact with the outer circumference of the electrode support member 3 as shown in FIG. 2(*b*). At the same time, the charging electrode 2 is pulled toward the charge acceptor 1 by an electrostatic force acting between the charge acceptor 1 and the charging electrode 2, so that the charging electrode 2 is driven frictionally by the charge acceptor 1.

The charging electrode 2 is formed by rolling a flexible semiconductive film of a thickness in the range of 30 to 200 μm formed of polyester, polyamide, polyethylene, polycarbonate, polyolefine, polyurethane, polyvinylidene fluoride or the like containing particles of a conductive substance, such as carbon black. The conductive particle content of the semiconductive film is determined selectively so that the semiconductive film has a desired volume resistivity. A volume resistivity of $10^2$ Ω·cm or below is liable to cause spark discharge and a volume resistivity of $10^{11}$ Ω·cm or above is liable to cause faulty dotted charging. Therefore, a desirable volume resistivity is in the range of $10^3$ to $10^{10}$ Ω·cm. A volume resistivity in the range of $10^3$ to $10^6$ Ω·cm is preferable because the charging voltage may be comparatively low and hence the charging device 10 consumes less power. Since the charging electrode 2 is in direct contact with the charge acceptor 1, the desirable tensile modulus of elasticity (JIS K7127) of the charging electrode 2 is in the range of 10 to 280 kg/mm$^2$. The durability of the charging electrode 2 is unsatisfactory when the tensile modulus of elasticity is less than 10 kg/mm$^2$, and creep is liable to occur when the tensile modulus is higher than 280 kg/mm$^2$.

Since power is fed to the charging electrode through the electrode support member 3 to the charging electrode 2, the circumference of the electrode support member is formed of a conductive material, for example, a metal, such as aluminum or a stainless steel, or a conductive polymeric material having a volume resistivity lower than that of the charging electrode 2. As shown in FIG. 1(*b*), the electrode support member 3 is slightly longer than the charging electrode. The electrode support member 3 is held fixedly in the charging device.

The power supply 4 applies a DC charging voltage to the charging electrode 2 to charge the charge acceptor 1. An ac power supply may be connected to the electrode support member 3 in addition to the DC power supply 4 as indicated by dotted lines in FIG. 1(*a*) to apply an ac charging voltage in addition to the DC charging voltage to the charging electrode 2.

Figure 3:
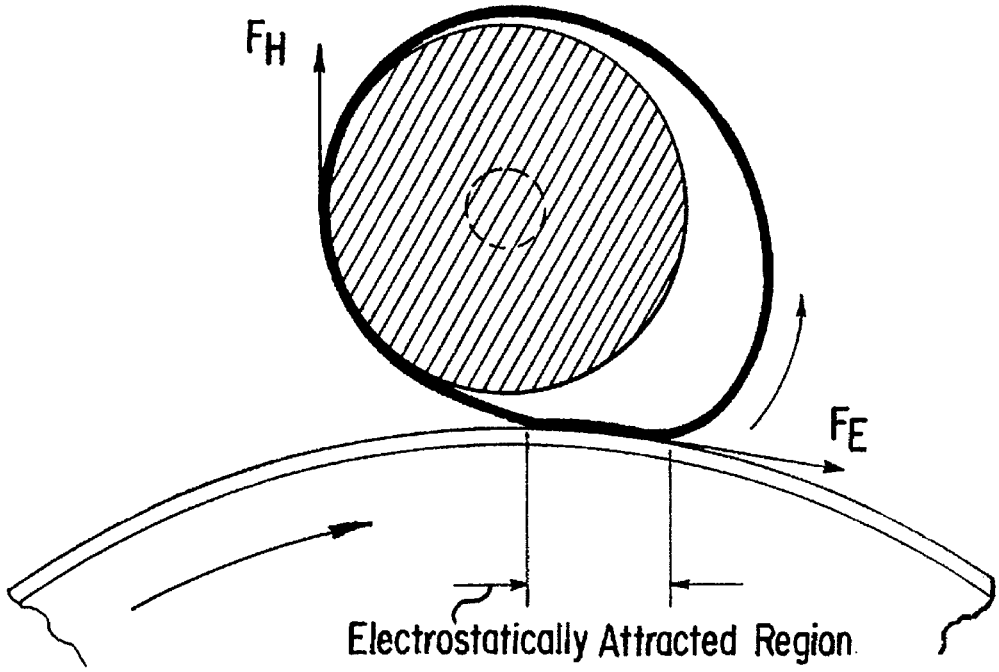
FIG. 3 is a schematic sectional view of assistance in explaining the operation of the charging device of FIGS. 1(*a*) and 1(*b*)

In operation, the power supply 4 applies a predetermined charging voltage through the electrode support member 3 to the charging electrode 2. Then, as shown in FIG. 3, the charging electrode 2 is attracted to the electrode support member 3 by an electrostatic force acting between the charging electrode 2 and the electrode support member 3 so that the inner surface of the charging electrode 2 is brought into contact with the electrode support member 3, and the charging electrode 2 is pulled toward the charge acceptor 1 by an electrostatic force acting between the charge acceptor 1 and the charging electrode 2. As the surface of the charge acceptor 1 moves in the fixed direction, the charging electrode 2 is driven frictionally for turning by the charge acceptor 1. During operation, the charging electrode 2 supported on the electrode support member 3 is in contact with the charge acceptor 1 at a fixed contact pressure and bulges partly in the moving direction of the surface of the charge acceptor 1. Since the predetermined charging voltage is applied to the charging electrode 2 by the power supply 4, a discharge is produced in the minute gap formed around a region in which the charging electrode 2 is in contact with the charge acceptor 1 and air prevailing around the minute gap is ionized. If the negative electrode of the power supply 4 is connected to the electrode support member 3, negative ions or electrons flow to the charge acceptor to charge the charge acceptor 1, while positive ions reaches the charging electrode and are neutralized.

Thus, the charging electrode 2 are in uniform contact with the charge acceptor 1 for stable power feed. Since the area of contact between the charge acceptor 1 and the charging electrode 2 is increased by the electrostatic force and the discharge region securing an appropriate gap is expanded as shown in FIG. 3, the charge acceptor 1 can be charged at a sufficient potential. The charging electrode 2 formed of a semiconductive material prevents the flow of an excessive current in any part of the gap and enables the uniform charging of the charge acceptor 1.

Figure 4:
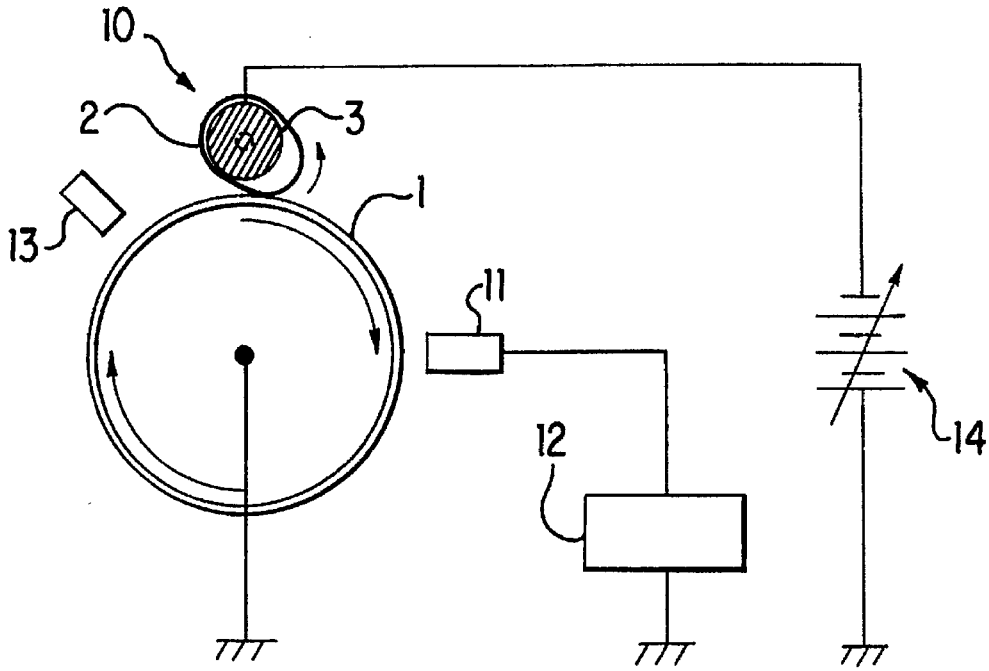
FIG. 4 is a diagrammatic view of a charging test apparatus for testing the charging device of FIGS. 1(*a*) and 1(*b*)

The charging device was tested for charging performance by using a charging testing apparatus shown in FIG. 4.

The charging testing apparatus has a surface potential detector 11 disposed near the surface of the charge acceptor 1 to detect the surface potential of the charge acceptor 1, a surface potentiometer 12 connected to the surface potential detector 11, a static eliminating lamp unit 13 disposed near the surface of the charge acceptor 1 to eliminate static charges from the surface of the charge acceptor 1, and a DC power supply 14. The charging device 10 is disposed before the surface potential detector 11 with respect to the moving direction of the surface of the charge acceptor 1 with the charging electrode 2 in contact with the surface of the charge acceptor 1. The electrode support member 2 is connected to the DC power supply 14. The supply voltage of the power supply 14, i.e., the charging voltage, is variable. The surface potential of the charge acceptor 1 that varies with the variation of the charging voltage is measured by the surface potentiometer 12.

Test charging electrodes 2 of 11 mm and 12.5 mm in diameter were formed by rolling 50 μm thick polyvinylidene fluoride, nylon and polycarbonate films respectively having volume resistivities of $10^3$, $10^5$ and $10^7$ Ω·cm. Electrode support members 3 of 8 mm, 10 mm and 12 mm in diameter were used.

Figure 5:
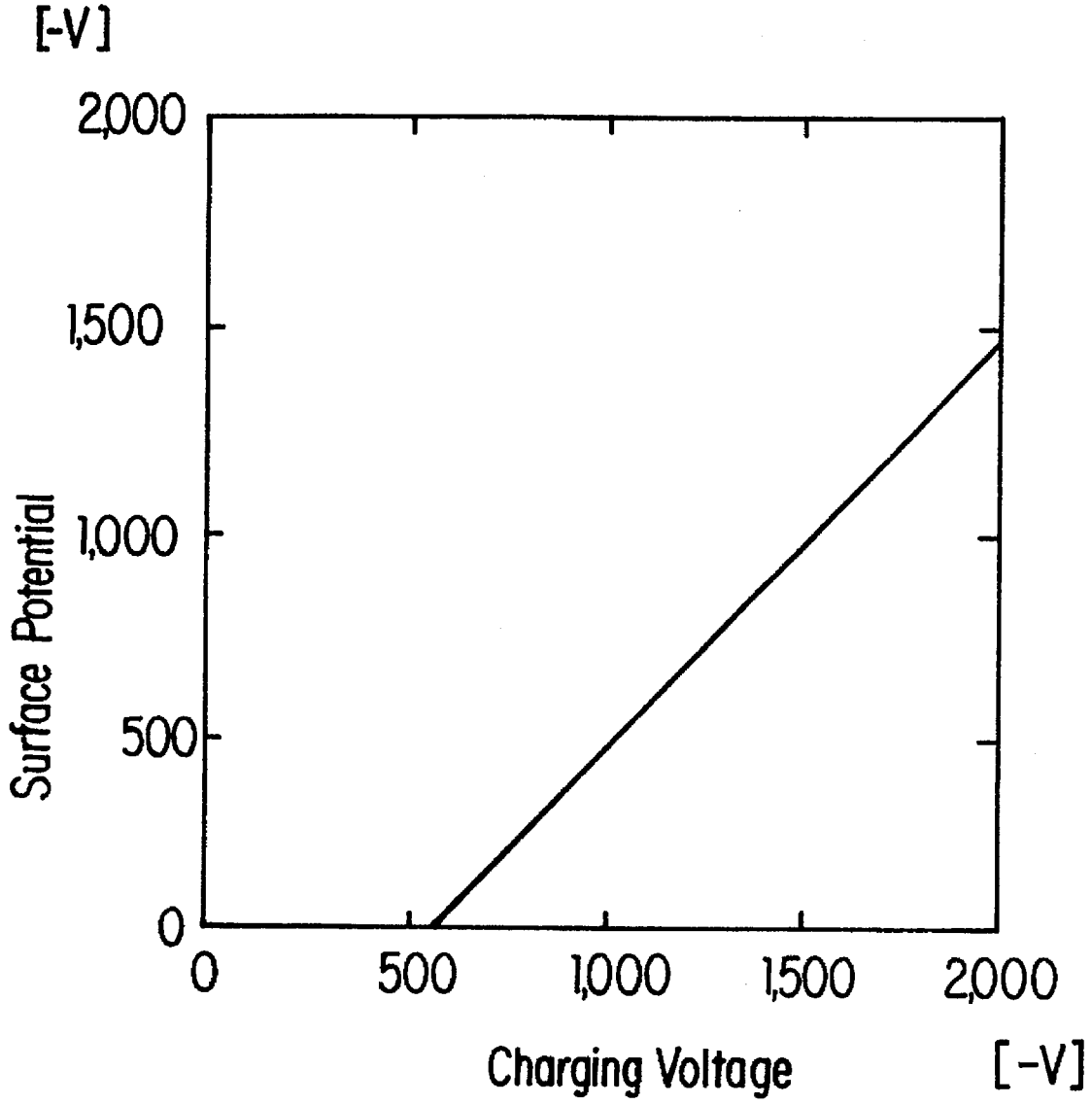
FIG. 5 is a graph showing the variation of the surface potential of a charge acceptor with the DC charging voltage applied to the charging electrode of the charging device of FIGS. 1(*a*) and 1(*b*)

FIG. 5 is a graph showing the variation of the surface potential of the charge acceptor 1 with the DC charging voltage applied to the charging electrode 2.

When the supply voltage of the DC power supply 14 was decreased from 0 V to −2000 V, the surface potential of the charge acceptor 1 started increasing when the supply voltage was increased to about −550 V, and increased to about −1450 V when the supply voltage was increased to −2000 V. No abnormal discharge occurred in the charging device 10 while the supply voltage was being increased from 0 V to −2000 V. All the charging electrodes 2 of different diameters and different materials, and all the combinations of the charging electrode 2 and the electrode support members 3 of different diameters were satisfactory in performance.

Figure 6:
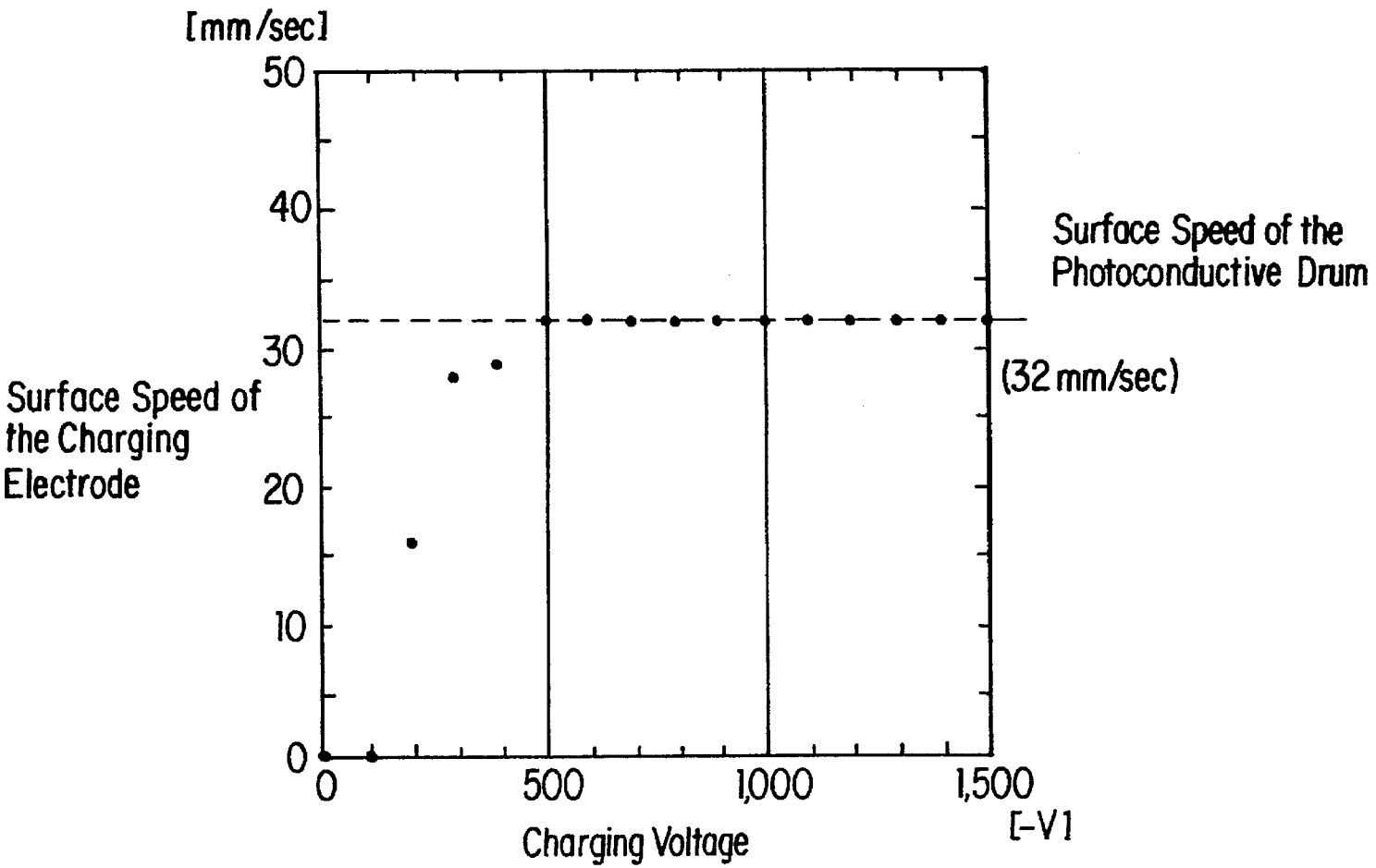
FIG. 6 is a graph showing the relation between the surface speed of the charging electrode of the charging device of FIGS. 1(*a*) and 1(*b*) and the DC charging voltage applied to the charging electrode.

The surface speed of the charging electrode 2 driven by the rotating charge acceptor 1 was measured. As shown in FIG. 6, the charging electrode 2 started turning when the supply voltage was decreased to about −200 V and alternately repeated turning and stopping due to slipping until the supply voltage was decreased to about −400 V. As the supply voltage was increased further, the charging electrode 2 started stable turning after the supply voltage was decreased beyond about −500 V, and the turning of the charging electrode 2 was stabilized and the charging electrode 2 turned at a fixed surface speed after the supply voltage was further decreased beyond about −500 V. It was found that the turning of the charging electrode 2 can be stabilized by the electrostatic force acting between the charge acceptor 1 and the charging electrode 2 and the charge acceptor 1 can be charged uniformly when an appropriate charging voltage is applied to the charging electrode 2. The surface speed of the charging electrode is the average of measurements measured during ten full turns of the charge acceptor 1. The charging device 10 can be formed in a small size because the charging device 10 need no special mechanism for turning the charging electrode 2.

Figure 7:
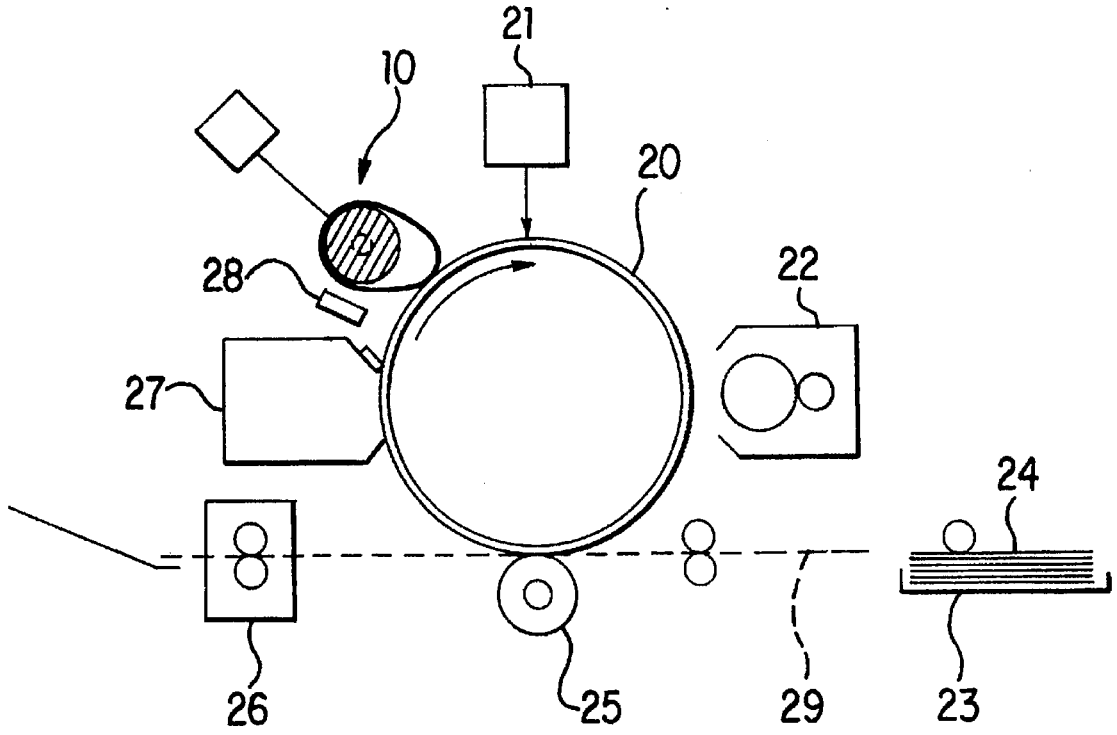
FIG. 7 is a diagrammatic view of an image forming apparatus employing the charging device of FIGS. 1(*a*) and 1(*b*)

An image forming apparatus employing the foregoing charging device 10 is shown in FIG. 7. The image forming apparatus is provided with a photoconductive drum (charge acceptor) 20, on which an electrostatic latent image is formed by uniformly charging the surface of the photoconductive drum 20 and scanning the charged surface with an image forming light beam. The charging device 10 of the present invention for charging the photoconductive drum 20, an exposure device 21, a developing unit 22, a transfer roller 25, a cleaning device 27 and a static eliminating lamp unit 28 are arranged around the photoconductive drum 20. Recording sheets 24 are fed successively from a sheet cassette 23, and toner images are fixed to the recording sheets 24 by a fixing device 26.

After the photoconductive drum 20 has been charged at a predetermined potential by the charging device 10, the exposure device 21 irradiates the surface of the photoconductive drum 20 with a laser beam representing image information to form an electrostatic latent image on the surface of the photoconductive drum 20. The developing device 22 develops the electrostatic latent image with toner to form a visible toner image. A recording sheet 24 fed from from the sheet cassette 23 is guided by a sheet guide 29 to a transfer position between the photoconductive drum 20 and the transfer roller 25, and the toner image is transferred by the transfer roller 25 from the photoconductive drum 20 to the recording sheet 24. Then the fixing device 26 fixes the toner image to the recording sheet 24 to produce a copy of a picture. As the photoconductive drum 20 rotates, the toner remaining on the photoconductive drum 20 is removed and the surface of the photoconductive drum 20 is cleaned by the cleaning device 27, charges remaining on the cleaned surface of the photoconductive drum 20 is removed by the static eliminating lamp unit 28, and then the surface of the photoconductive drum 20 is charged again by the charging device 10. In the charging process, a DC charging voltage of −900 V or a charging voltage produced by superposing a DC charging voltage of −350 V and an ac charging voltage of 1500 V in peak-to-peak value is applied to the charging device 10 to charge the surface of the photoconductive drum 20 at a potential of about −350 V.

Figure 9A:
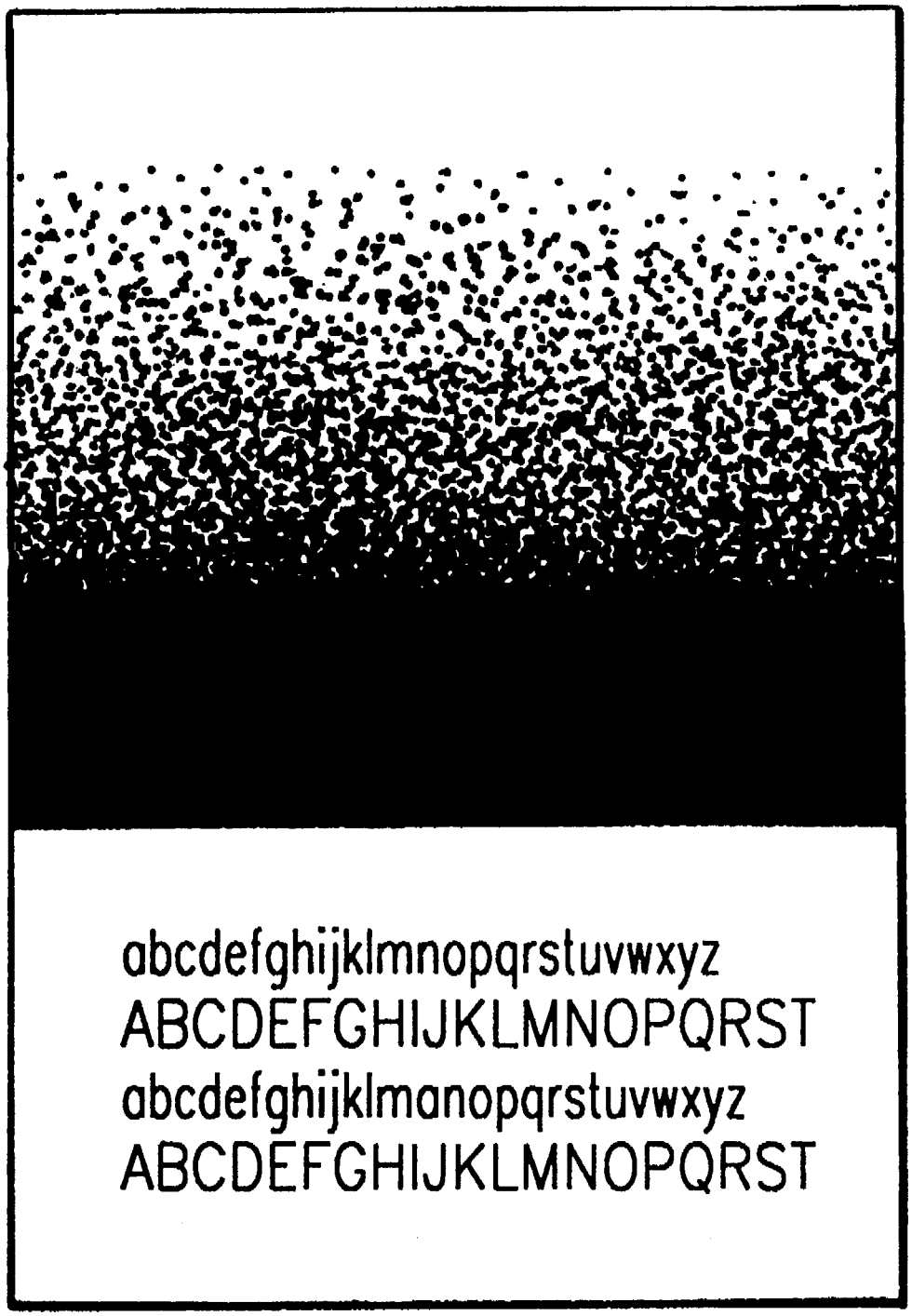
FIGS. 9(*a*) and 9(*b*) are plan views of sheets carrying images formed by the image forming apparatus of FIG. 7.
Figure 9B:
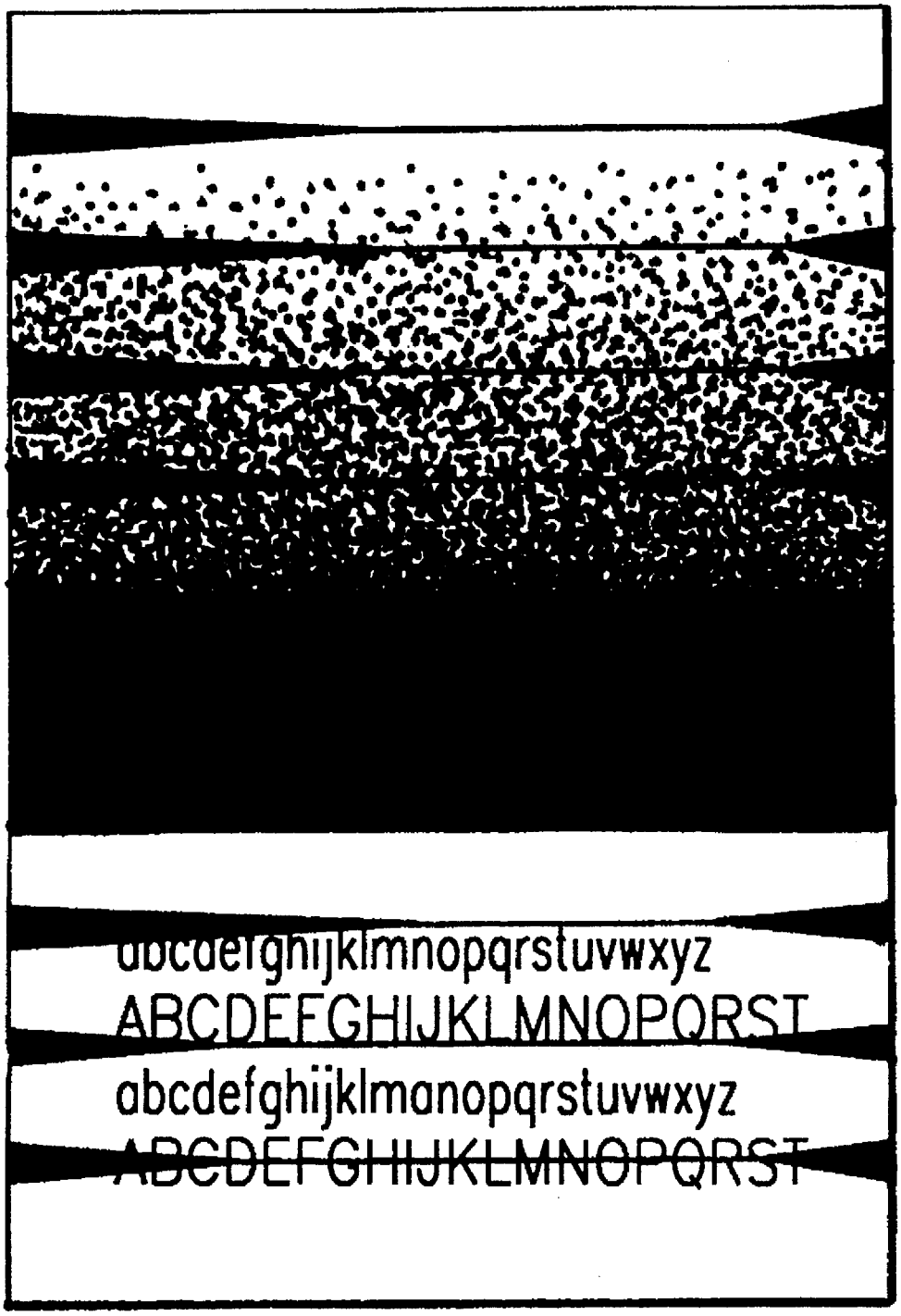

Experimental image forming operation of the image forming apparatus was carried out to test the reliability of the charging device 10. The surface of the photoconductive drum 20 was charged in a uniform potential distribution and satisfactory images free from defects as shown in FIG. 9(*a*) were formed.

Figure 8:
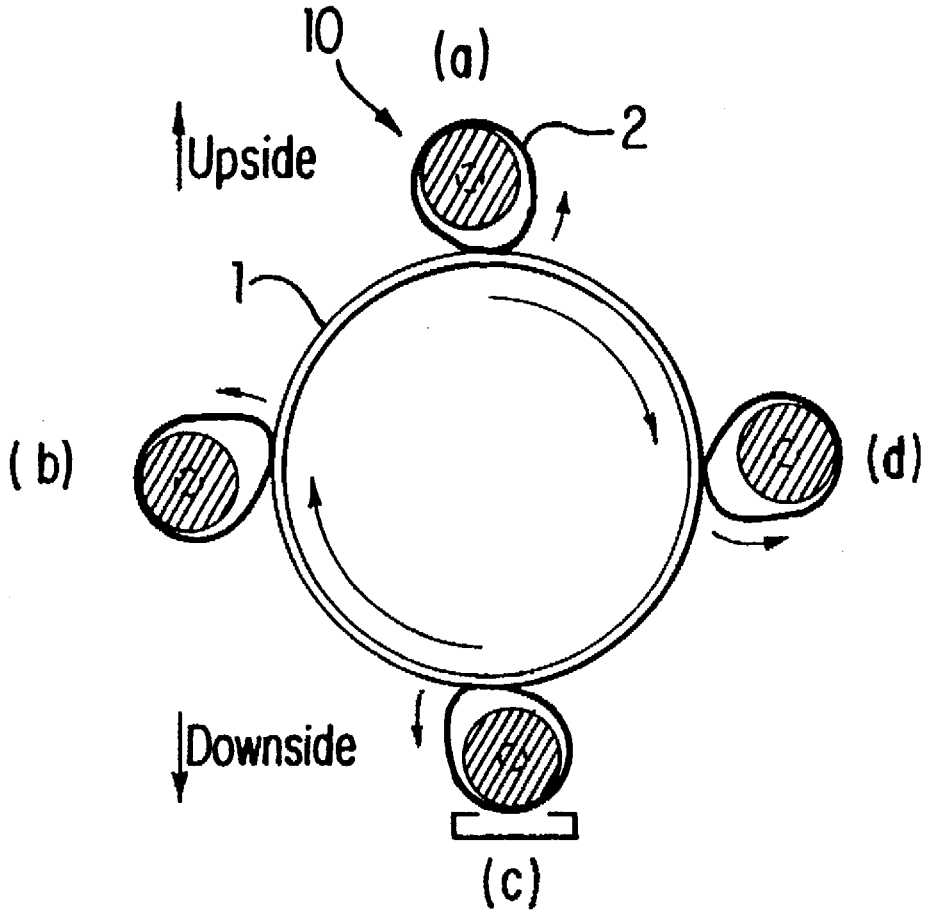
FIG. 8 is a diagrammatic view showing possible positions of the charging device of FIGS. 1(*a*) and 1(*b*) around a charge acceptor.

The position of the charging device 10 relative to the photoconductive drum 20 was changed between four positions (*a*), (*b*), (*c*) and (*d*) as shown in FIG. 8 and charging tests and image forming tests were carried out to examine the effect of the position of the charging device 10 relative to the photoconductive drum 20 on the charging characteristic of the charging device 10. When the charging device 10 was disposed at position (*b*), (*c*) or (*d*), the turning of the charging electrode 2 was unstable. Faulty charging of the surface of the photoconductive drum 20 was conspicuous and periodic, transverse black lines were formed at intervals corresponding to the circumferential length of the charging electrode 2 as shown in FIG. 9(*b*) when the charging device 10 was disposed at position (*c*). When the charging device 10 was disposed at position (*a*), the surface of the photoconductive drum 20 was charged stably and satisfactory images free from defects were formed.

The charging device 10 is applied to image forming apparatuses like that shown in FIG. 7. The charging device 10 may be formed integrally with a toner cartridge to install the charging device 10 detachably in the image forming apparatus. The discharge device 10 formed integrally with a toner cartridge can be recovered when the toner cartridge has exhausted, and only the charging electrode 2 is replaced with a new one to recycle the discharge device 10, which is effective in reducing the cost of the charging device 10.

Figure 10A:
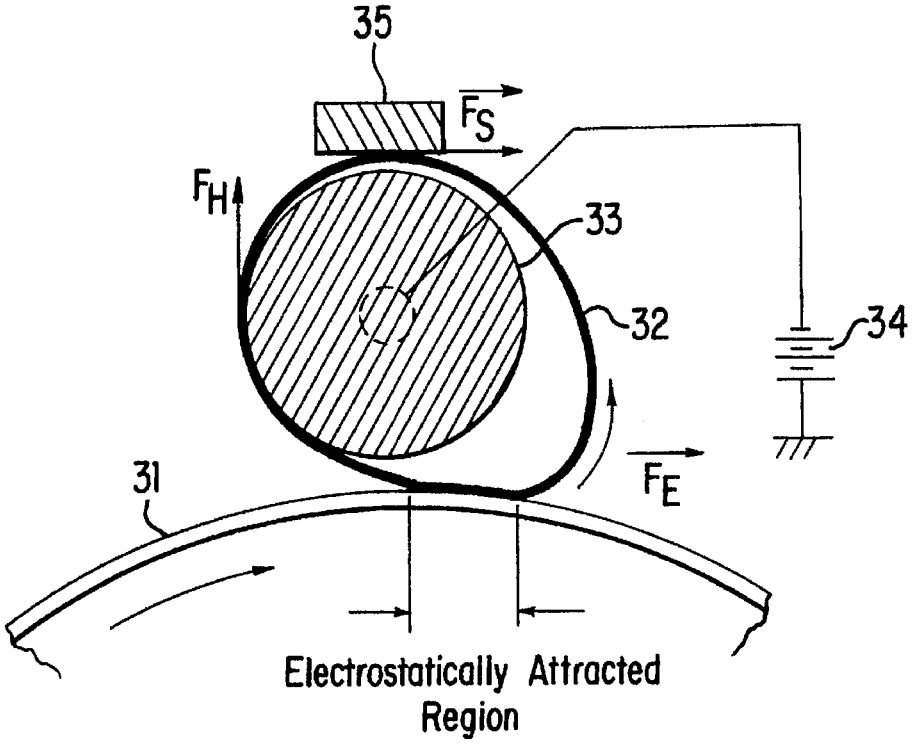
FIGS. 10(*a*) and 10(*b*) are a schematic sectional view and a schematic side view, respectively, of a charging device in a second embodiment according to the present invention.
Figure 10B:
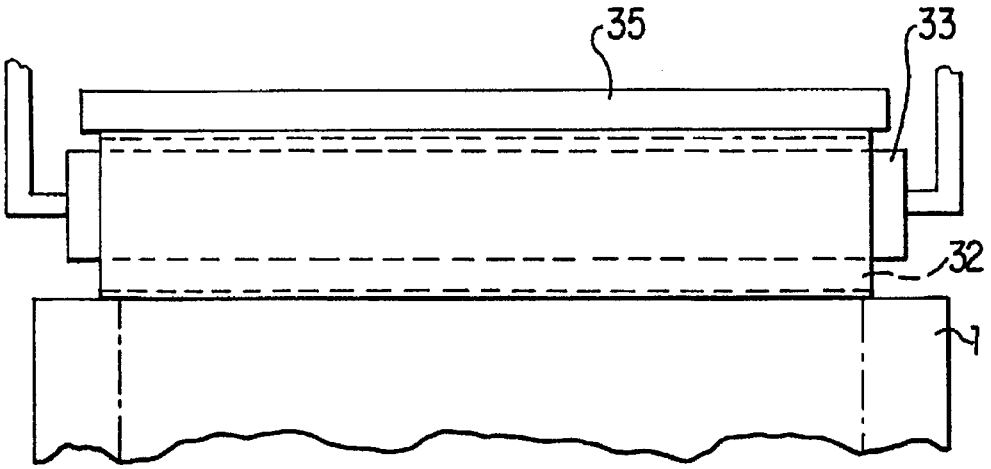

Referring to FIGS. 10(*a*) and 10(*b*) showing a charging device in a second embodiment according to the present invention, the charging device in the second embodiment is substantially the same in construction as the charging device 10 in the first embodiment, except that the charging device in the second embodiment is provided, in addition to the component of the charging device in the first embodiment, with an electrode stabilizing member 35 for stabilizing the turning of a charging electrode 32. The electrode stabilizing member 35 is supported above and spaced from an electrode support member 33. The electrode stabilizing member 35 is an elongate member having substantially the same rectangular cross section over the entire length thereof and is extended along the axis of a charge acceptor 31 so as to be in contact with the outer circumference of the charging electrode 32 to press the charging electrode 32 lightly toward the charge acceptor 31.

Desirably, the electrode stabilizing member 35 is formed by shaping a soft material, such as foam polyethylene, foam polyurethane, silicone sponge or felt, in the shape of a plate. The electrode stabilizer is positioned and supported not to press the charging electrode 32 firmly to the electrode support member 33 and to be in contact with the outer surface of the charging electrode 32.

When a charging voltage is applied to the charging electrode 32, the charging electrode 32 is attracted to the electrode support member 33 by an electrostatic force acting between the charging electrode 32 and the electrode support member 33, and the charging electrode 32 is pulled in the moving direction of the surface of the charge acceptor 31 by an electrostatic force acting between the charge acceptor 31 and the charging electrode 32. The electrode stabilizing member 35 prevents the excessive deformation of the charging electrode 32 due to centrifugal force or the like and pushes the charging electrode 32 toward the charge acceptor 31.

When a charging voltage is applied to the charging electrode 32 and the charge acceptor 31 is driven, a frictional force $F_E$ produced between the charge acceptor 31 and the charging electrode 32 by an electrostatic force acting between the charge acceptor 31 and the charging electrode 32 acts to force the charging electrode 32 to turn along the surface of the charge acceptor 31, and a frictional force $F_H$ produced between the charging electrode 32 and the electrode support member 33 and a frictional force $F_S$ produced between the charging electrode 32 and the electrode stabilizing member 35 act against the movement of the charging electrode 32 in directions shown in FIG. 10(*a*). Therefore, the charging electrode 32 turns when $F_E > F_S + F_H$. Practically, the frictional force $F_E$ is dependent on the charging voltage applied to the charging electrode 32 and the frictional force $F_H$ is dependent on the surface conditions of the charging electrode 32 and the electrode support member 33. Therefore, when the charging voltage and setting conditions for the charging electrode 32 and the electrode support member 33 are fixed, the material and the position of the electrode stabilizing member 35 may be determined so as to meet the aforesaid inequality.

In this charging device, the turning motion of the charging electrode 32 is stabilized by the electrode stabilizing member 35 in contact with the charging electrode 32. Results of the charging tests showed that the electrode stabilizing member 35 stabilizes the turning of the charging electrode, the charging device is capable of stably charging the charge acceptor 31 in a uniform potential distribution regardless of the position of the charging device around the charge acceptor 31, and the charging electrode 32 is able to charge the charge acceptor 31 stably even if the roundness and the straightness of the charging electrode 32 are not very high. Thus, the component parts of the charging device need not be formed in very high accuracies and the charging device can be manufactured at a comparatively low cost. The charging device is able to charge the charge acceptor stably even when a superposed charging voltage produced by superposing a DC voltage and an AC voltage, which, as compared with a DC charging voltage, is liable to make the charging electrode 32 unstable, is applied to the charging electrode 32, and charging noise can be reduced.

Figure 11:
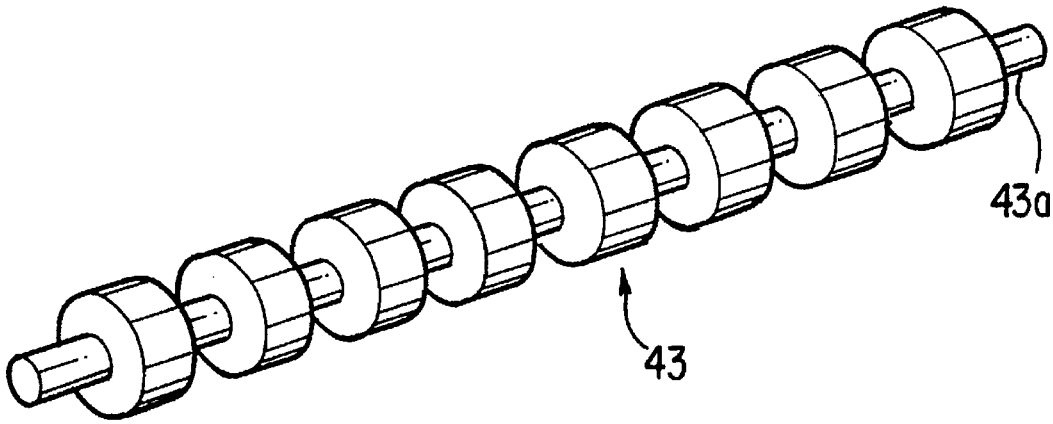
FIG. 11 is a schematic perspective view of an electrode support member included in a modification of the charging device of FIGS. 10(*a*) and 10(*b*)

FIG. 11 is a schematic perspective view of an electrode support member 43 included in a modification of the charging device in the second embodiment.

The charging device in a modification of the charging device in the second embodiment is provided with the electrode support member 43 instead of the electrode support member 33 of the charging device shown in FIGS. 10(*a*) and 10(*b*). The electrode support member 43 is a grooved roller formed by mounting a plurality of rollers on a support shaft 43*a* at equal intervals. Since the surfaces of the rollers of the electrode support member 43 are in contact with the charging electrode 32, the contact area between the electrode support member 43 and the charging electrode 32 is smaller than that between the electrode support member 33 and the charging electrode 32. The electrode support member 43 is formed of a metal, such as aluminum, an EPDM (ethylene-propylene terpolymer) containing conductive powder, such as carbon black or the like, or a fluororesin containing conductive powder, such as carbon black or the like, and has a volume resistivity smaller than that of the charging electrode 32.

Figure 12:
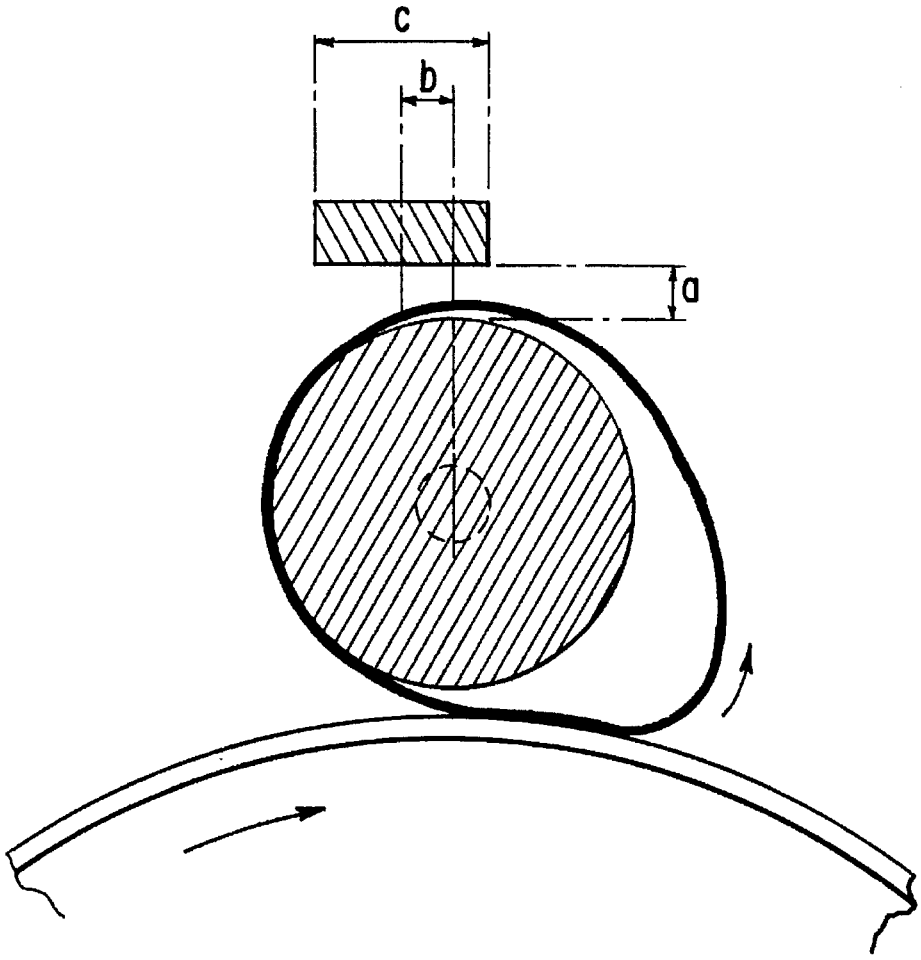
FIG. 12 is a schematic sectional view of assistance in explaining the disposition of the component members of the charging device of FIGS. 10(*a*) and 10(*b*)

The charging device was operated for charging tests and image forming tests to evaluate the effect of the shape and the material of the electrode support member 43, in which electrode stabilizing members of 2 mm, 4 mm and 6 mm in width c (FIG. 12) were tested and the position of the electrode stabilizing member 35 was varied for three values of the distance a between surfaces of the rollers of the electrode support member 43 and the surface of the electrode stabilizing member 35 facing the electrode support member 43 and three values of the center distance b between the electrode support member 43 and the electrode stabilizing member 35 (FIG. 12). The electrode stabilizing member 35 was formed of foam polyurethane. Test operation was performed also by using the cylindrical electrode support member 33 shown in FIG. 10(*a*) for comparison.

Results of the charging tests and the image forming tests are shown in Table 1.

TABLE 1

| | Width c of electrode stabilizing member (mm) | | |
|---|---|---|---|
| | 6 | 4 | 2 |
| Aluminum roller | x | x | o |
| Aluminum grooved roller | Δ | o | o |
| EPDM roller | x | x | Δ |

TABLE 1-continued

| | | | |
|---|---|---|---|
| Fluororesin roller | Δ | Δ | o |
| | Position of electrode stabilizing member relative to electrode support member | | |
| | Front | Middle | Back |
| Aluminum roller | o | Δ | x |
| Aluminum grooved roller | o | o | Δ |
| EPDM roller | x | x | x |
| Fluororesin roller | o | o | Δ |
| | Vertical position of electrode stabilizing member relative to electrode support member | | |
| | High | Middle | Low |
| Aluminum roller | o | Δ | x |
| Aluminum grooved roller | o | o | x |
| EPDM roller | Δ | x | x |
| Fluororesin roller | o | Δ | x |

o: Satisfactory charging
Δ: Slightly irregular charging
x: Unsatisfactory image quality due to faulty charging As is evident from Table 1, the aluminum grooved roller, as compared with the aluminum roller, expands the allowable ranges of size and position of the electrode stabilizing member, and the performance of the fluororesin roller, i.e., the electrode support member of a fluororesin, is substantially the same as that of the aluminum grooved roller. The EPDM roller, which is comparatively highly frictional, narrows the allowable ranges of size and position of the electrode stabilizing member and hence the size and position of the electrode stabilizing member must be carefully determined when the EPDM roller is employed.

It is known from the results of the test operation that the allowable ranges of dimensional and positional conditions of the components can be expanded and stable charging operation can be secured by reducing the frictional force acting between the charging electrode and the electrode support member and using the electrode stabilizing member.

Figure 13:
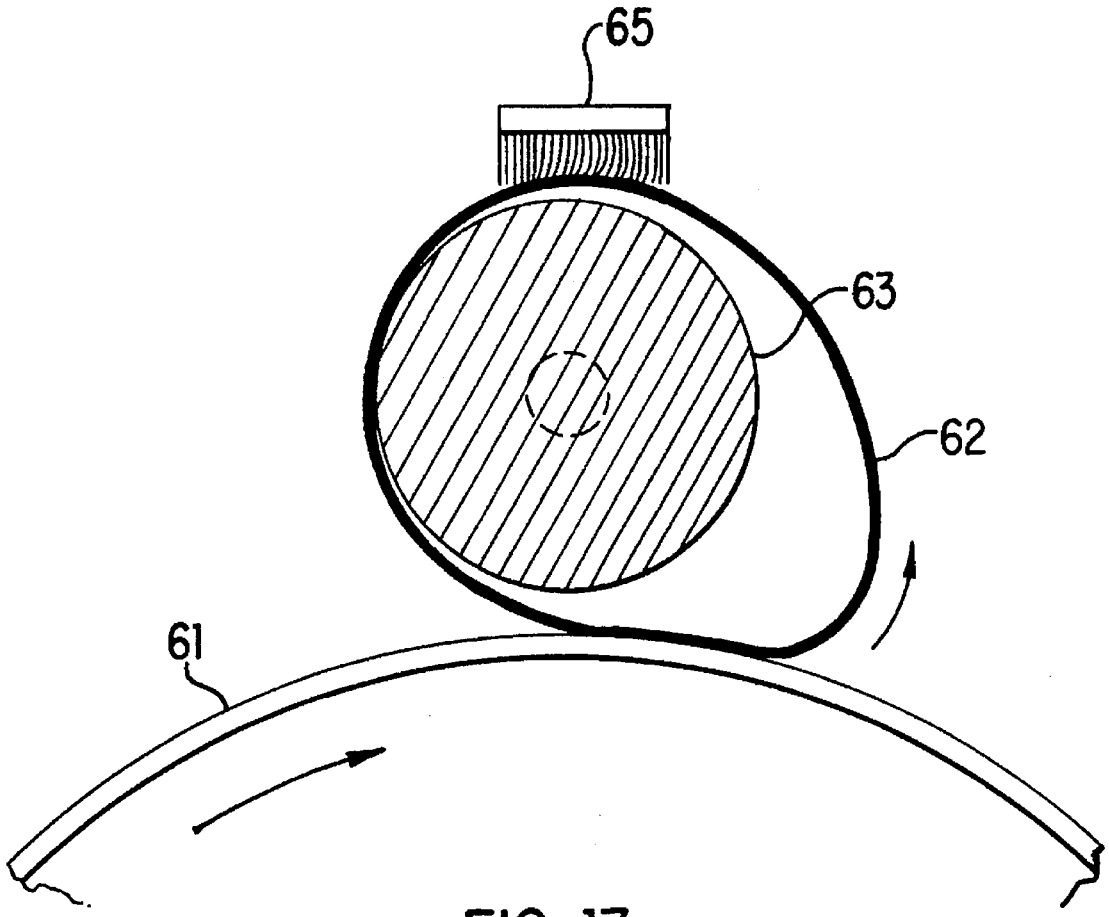
FIG. 13 is a schematic sectional view of a charging device in a third embodiment according to the present invention.

Referring to FIG. 13, a charging device in a third embodiment according to the present invention is substantially the same in construction as the charging device shown in FIGS. 10(*a*) and 10(*b*) except that the charging device in the third embodiment is provided with a brush-like electrode stabilizing member 65 formed by setting bristles into a plate 65*a* instead of the electrode stabilizing member 35 of the charging device shown in FIGS. 10(*a*) and 10(*b*). The bristles of the electrode stabilizing member 65 are fibers of a polymeric material, such as rayon fibers, acrylic fibers, nylon fibers, polypropylene fibers or polyethylene terephthalate fibers.

Results of the image forming test operation of an image forming apparatus provided with the charging device in the third embodiment showed that satisfactory images can be formed. Since the brush-like electrode stabilizing member 65 is in contact more softly than the plate-shaped electrode stabilizing member 35, the allowable ranges of positional conditions for the electrode stabilizing member 65 is wider than those for the plate-shaped electrode stabilizing member 35.

Figure 14A:
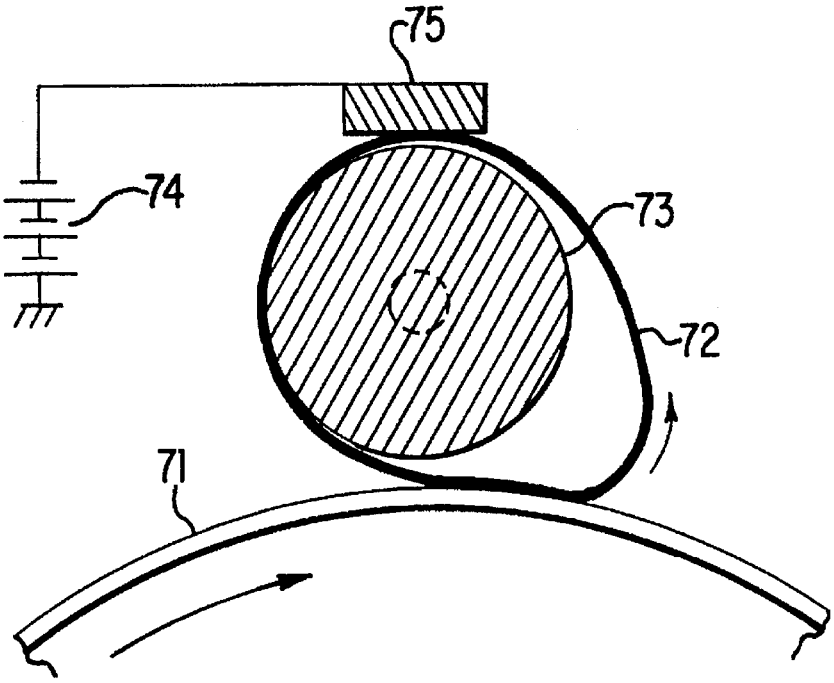
FIGS. 14(*a*) and 14(*b*) are schematic sectional view and a schematic side view, respectively, of a charging device in a fourth embodiment according to the present invention.
Figure 14B:
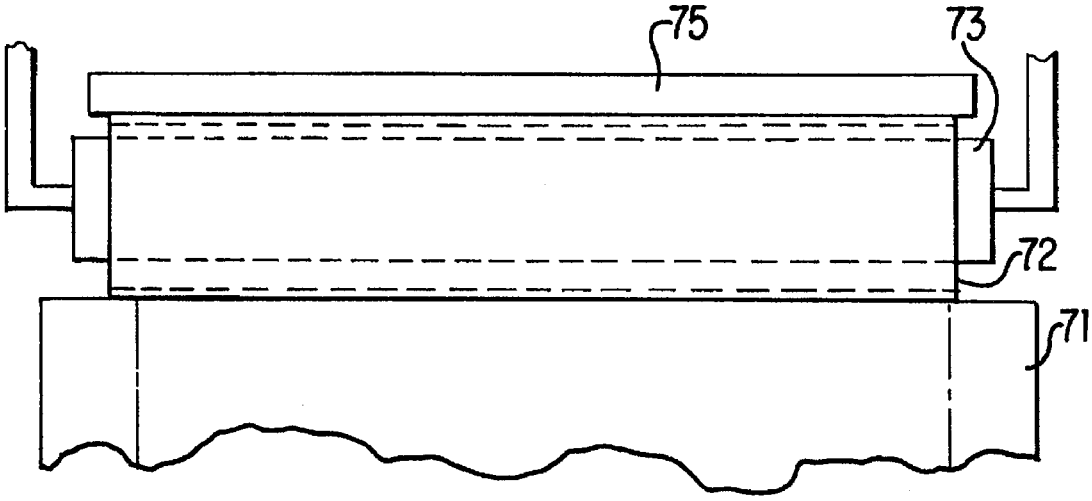

Referring to FIGS. 14(*a*) and 14(*b*) showing a charging device in a fourth embodiment according to the present invention, the charging device in the fourth embodiment is substantially the same in construction as the charging device shown in FIGS. 10(*a*) and 10(*b*) except that the charging device in the fourth embodiment is provided with a cylindrical electrode support member 73 formed of an insulating material, and a electrode stabilizing member 75 formed of a conductive material. The electrode stabilizing member 75 is connected to a power supply 74. The electrode support member 73 and the electrode stabilizing member 75 are the same in shape as the electrode support member 33 and the electrode stabilizing member 35 of the charging device shown in FIGS. 10(*a*) and 10(*b*), respectively.

Results of the image forming test operation of an image forming apparatus employing the charging device showed that satisfactory images can be formed. Since the electrode support member 73 need not be formed of a conductive material containing conductive powder, such as carbon powder, the frictional force acting between the charging electrode 72 and the electrode support member 73 can be further reduced, so that the charging electrode 72 is able to turn more stably.

Figure 15A:
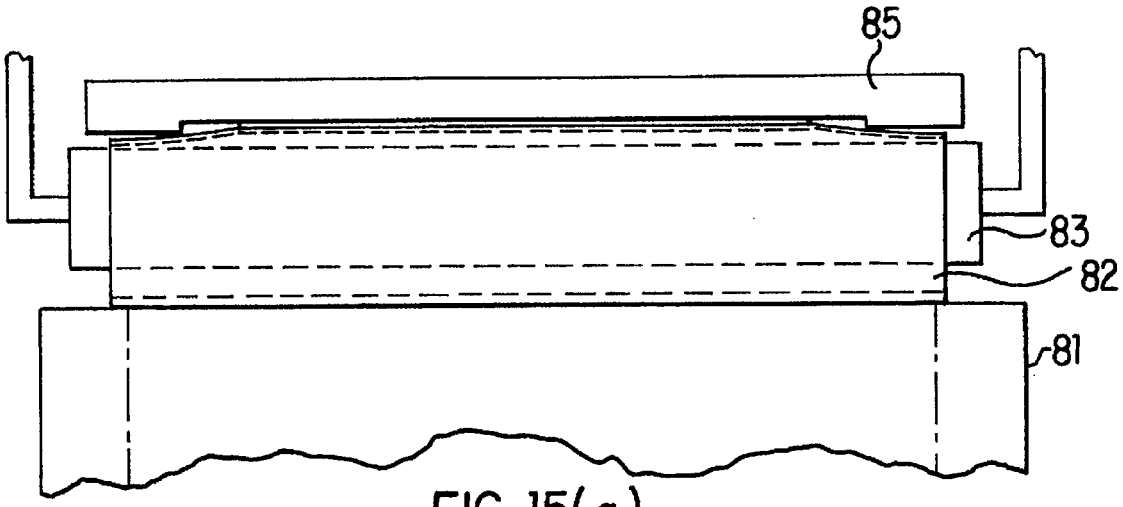
FIGS. 15(*a*) and 15(*b*) are a schematic side view of a charging device in a fifth embodiment according to the present invention and a schematic perspective view of an electrode stabilizing member included in the charging device of FIG. 15(*a*)
Figure 15B:
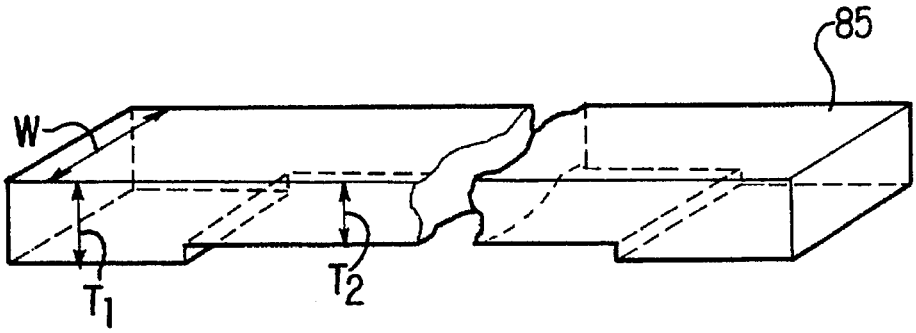

Referring to FIGS. 15(*a*) and 15(*b*) showing a charging device in a fifth embodiment according to the present invention, which is substantially the same in construction as that shown in FIGS. 10(*a*) and 10(*b*), the charging device is provided with an electrode stabilizing member 85 having the shape of an elongate plate. The middle portion of the working surface of the electrode stabilizing member 85 is recessed so that the thickness $T_1$ of the opposite end portions are greater than the thickness $T_2$ of the middle portion. Therefore, the effect of the opposite end portions of the electrode stabilizing member 85 is greater than that of the middle portion of the same in pressing a charging electrode 82 toward an electrode support member 83. The electrode stabilizing member 85 is supported so that the opposite end portions of $T_1$ in thickness are in contact with the opposite side portions of the charging electrode 82, respectively.

The electrode stabilizing member 85 may be formed of the same material as that forming the electrode stabilizing member 35 shown in FIGS. 10(*a*) and 10(*b*), such as a foam material. The electrode stabilizing member 85 may be formed by combining parts of different thicknesses.

The material, dimensions and positional condition of the electrode stabilizing member 85 are as follows.

Material: Foam urethane resin

Gap between the middle portion and the electrode support member 83: 0.75 mm

Gap between the opposite side portions and the electrode support member 83: 0.25 mm Width W: 4 mm Thickness $T_1$: 2.5 mm Thickness $T_2$: 2.0 mm The operation of the charging device will be described hereinafter.

Generally, the opposite side portions of a charging electrode formed by rolling a film in a cylindrical shape have a tendency to be deformed more greatly than other portions when static charges on a charge acceptor are eliminated uniformly with respect to the axial direction when the charging electrode is turned by an electrostatic force acting between the charging electrode and the charge acceptor. If the electrostatic force acting between the charging electrode and the charge acceptor is very high, the appropriate contact between the charging electrode and the charge acceptor cannot be secured due to the large deformation of the opposite side portions of the charging electrode and, consequently, the opposite side portions of the charge acceptor cannot be satisfactorily charged and foggy defects are formed in portions of an image near the opposite side portions of a recording sheet. Therefore, the electrode stabilizing member 85 of the charging device in the fifth embodiment is formed so that the effect of the opposite end portions of the electrode stabilizing member 85 is higher than that of the middle portion of the same in pressing the charging electrode 82. Consequently, excessively large deformation of the opposite side portions of the charging electrode 82 can be avoided, the charge acceptor 81 can be charged in a uniform potential distribution and the formation of foggy defects in images can be prevented.

Results of the image forming test operation of an image forming apparatus employing this charging device showed that no foggy defect is formed in portions of images near the opposite sides portions of recording sheets and images can be formed in a satisfactory image quality.

The charging device may be provided with an electrode stabilizing member having the shape of a brush instead of the electrode stabilizing member 85 formed of a foam material, and the electrode stabilizing member having the shape of a brush may be formed by properly setting bristles of different lengths into a plate.

Figure 16:
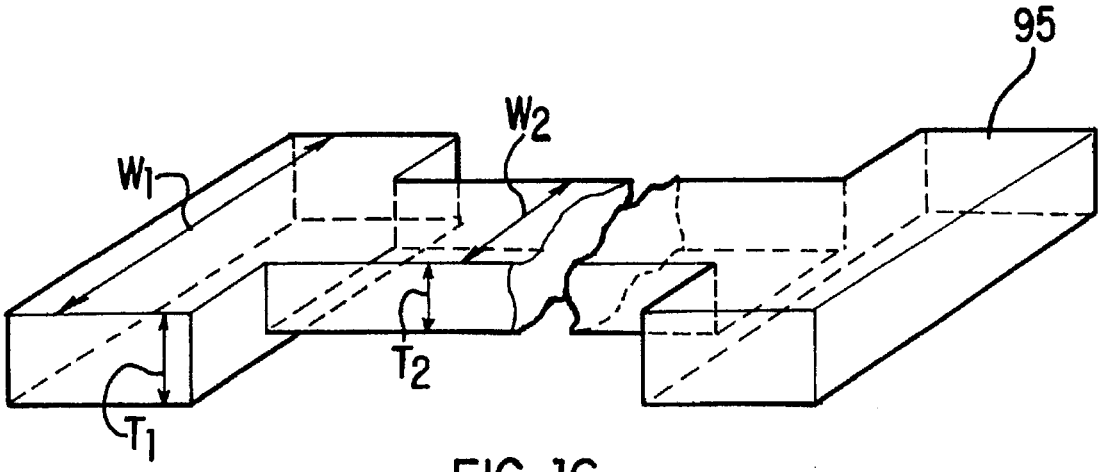
FIG. 16 is a perspective view of an electrode stabilizing member employed in a modification of the charging device of FIGS. 15(*a*) and 15(*b*)

FIG. 16 is a perspective view of an electrode stabilizing member 95 employed in a modification of the charging device of FIGS. 15(*a*) and 15(*b*).

The electrode stabilizing member 95 has expanded opposite end portions having a width $W_1$, i.e., size along the turning direction of the charging electrode, greater than the width $W_2$ of the middle portion and having a thickness $T_1$ greater than the thickness $T_2$ of the middle portion. Therefore, the contact area between each expanded end portion of the electrode stabilizing member 95 and the charging electrode is greater than that between the middle portion of the electrode stabilizing member 95 and the charging electrode. In this embodiment, $T_1$, $T_2$, $W_1$ and $W_2$ are 2.5 mm, 2 mm, 8 mm and 4 mm, respectively.

The electrode stabilizing member 95 may be formed of the same material as that forming the electrode stabilizing member 85 shown in FIGS. 15(*b*) and the electrode stabilizing member 95 may be formed by combining parts of different thicknesses and different lengths. The charging device employing the electrode stabilizing member 95 is the same in construction as the charging device shown in FIGS. 15(*a*) and 15(*b*).

The effect of the opposite end portions of the electrode stabilizing member 95 is greater than that of the middle portion of the same in pressing the charging electrode toward a charge acceptor. Consequently, the electrode stabilizing member 95 is capable of preventing the formation of foggy defects in portions of an image near the opposite side portions of a recording sheet and of preventing the transverse dislocation of the charging electrode relative to the charge acceptor for stable charging.

Results of the image forming test operation of an image forming apparatus employing this charging device showed that images can be formed in a satisfactory image quality. A comparative image forming test operation was carried out by using an image forming apparatus provided with a charging device including an electrode stabilizing member having opposite end portions and a middle portion which are the same in effect in pressing the charging electrode and in contact area for a comparative image forming. Faint foggy stripes were formed in portions of an image near the opposite side portions of a recording sheet when the width of the charging electrode was comparatively small as compared with the width of the recording sheet.

Figure 17:
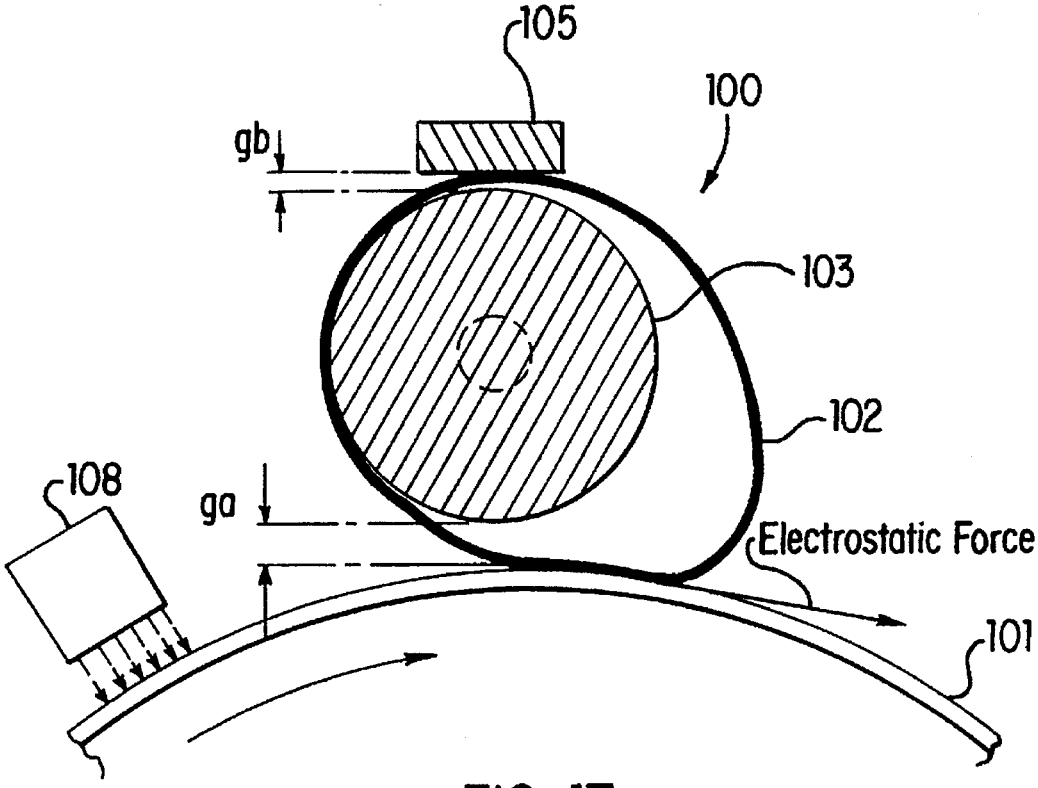
FIG. 17 is a schematic sectional view of a charging device and a static eliminating device included in an image forming apparatus in a sixth embodiment according to the present invention.

FIG. 17 is a schematic sectional view of a charging device 100 and a static eliminating lamp unit 108 included in an image forming apparatus in a sixth embodiment according to the present invention.

This image forming apparatus is substantially the same in construction as that shown in FIG. 7, except that this image forming apparatus is provided with the charging device 100 and the static eliminating lamp unit 108 instead of the charging device 10 and the static eliminating lamp unit 28 of FIG. 7.

The charging device 100, similarly to the charging device shown in FIGS. 10(*a*) and 10(*b*), comprises, as principal components, a charging electrode 102, an electrode support member 103, an electrode stabilizing member 105, and a power supply, not shown, for applying a charging voltage to the charging electrode 102.

The static eliminating lamp unit 108 comprises LEDs and irradiates a photoconductive drum 101 with light emitted by the LEDs to eliminate static charges from the surface of the photoconductive drum 101 to reduce the surface potential of the photoconductive drum 101 substantially to 0 V.

Figure 18:
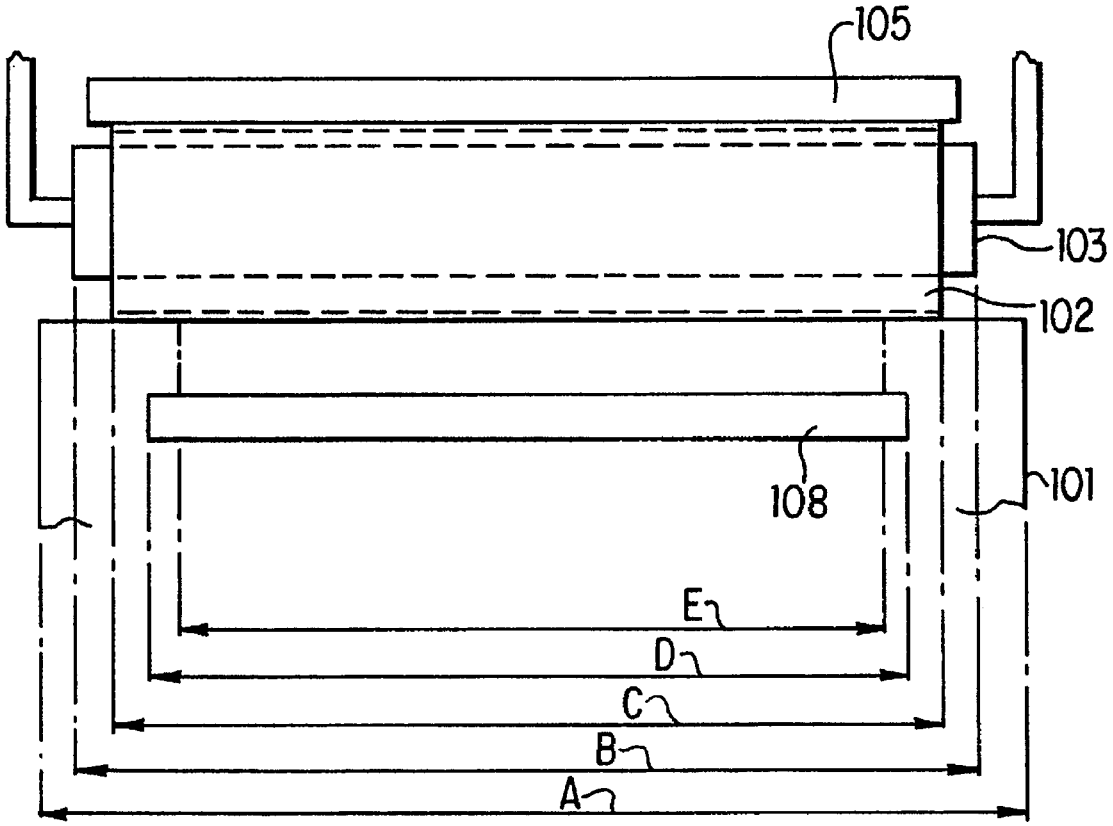
FIG. 18 is a side view of assistance in explaining the respective widths of the components of the image forming apparatus of FIG. 17.

As shown in FIG. 18, the static eliminating lamp unit 108 eliminates static charges in a limited range. The effective width D of the static eliminating lamp unit 108 is determined so as to meet an inequality: A>B>C>D>E, where A is the width of the photoconductive drum 101, B is the width of the electrode support member 103, C is the width of the charging electrode 102, D is the width of the static eliminating lamp unit 108, and E is the width of an image forming area.

The following are the specifications of the image forming apparatus.

Photoconductive Drum 101

Organic photoconductive layer: 17 μm in thickness

Potential: Background: −360 V, Image: −10 V

Developing Device

Developer: One-component magnetic toner

Developing bias voltage: −280 V DC 2 kHz, $V_{F-P}$, 2 kV AC

Transfer Device

Transfer roller: Foam urethane containing carbon

Volume resistivity: $10^7$ Ω·cm

Power supply: 1.5 μA, Constant current control

Cleaning Device

Cleaning blade: Urethane rubber blade

Charging Electrode 102

Film: 50 μm thick polyvinylidene fluoride film containing carbon

Outside diameter: 12.5 mm

Volume resistivity: $10^6$ Ω·cm

Tensile modulus of elasticity: 100 kg/mm$^2$

Charging voltage: −1 kV

Electrode Support Member 103 (Roller)

Material: Aluminum

Outside diameter: 10.5 mm

Gap between electrode support member 103 and photoconductive drum 101: 1 mm Electrode Stabilizing Member 105

Material: Foam urethane

Gap between electrode stabilizing member 105 and photoconductive drum 101: 0.75 mm Width: 4 mm Static Eliminating Lamp Unit 108

Light source: LEDs

Wavelength: 660 nm

Effective Widths of Component Parts (mm)

Photoconductive drum (A): 260

Electrode support member (B): 255

Charging electrode (C): 250

Static eliminating lamp unit (D): 215 (Comparative static eliminating lamp unit: 255)

Image forming area (E): 210

In this image forming apparatus, when a charging voltage of −350 V is applied to the charging electrode 102, the surface potential of the photoconductive drum 101 after the transference of an image from the photoconductive drum 101 to a recording sheet is in the range of about −250 to about −300 V in unexposed area, i.e., an area not exposed to exposure light emitted by the exposure device, and in the range of 0 to about −10 V in the exposed area, i.e., an area exposed to exposure light emitted by the exposure device. When the surface of the photoconductive drum 101 is exposed to light emitted by the static eliminating lamp unit 108, the surface potential of the photoconductive drum 101 changes uniformly to about 0 V.

The width D of the static eliminating lamp unit 108 is smaller than the width C of the charging electrode 102 and, in most cases, the opposite side portions of a recording sheet are not exposed to exposure light. Therefore, the surface potential of the opposite side portions of the photoconductive drum 101 is in the range of about −250 to about −300 V and the surface potential of the middle portion of the photoconductive drum 101 exposed to the static eliminating light is about 0 V when the surface of the photoconductive drum 101 is subjected to the charging action of the charging electrode 102.

The charging electrode 102 is turned by the agency of the electrostatic force acting between the charging electrode 102 and the photoconductive drum 101. When the subace potential of the photoconductive drum 101 is regulated as mentioned above, the electrostatic force acting between the middle portion of the charging electrode 102 and the photoconductive drum 101 is greater than that acting between the opposite side portions of the charging electrode 102 and the photoconductive drum 101. Consequently, the excessive deformation of the opposite side portions of the charging electrode 102 can be avoided and the charging electrode 102 and the photoconductive drum 101 are kept in uniform contact with respect to the axial direction. Therefore, the irregular charging of the photoconductive drum 101 and the formation of foggy defects in areas of an image near the opposite side portions of the recording sheet can be avoided, and the image can be formed in a satisfactory image quality.

Figure 19A:
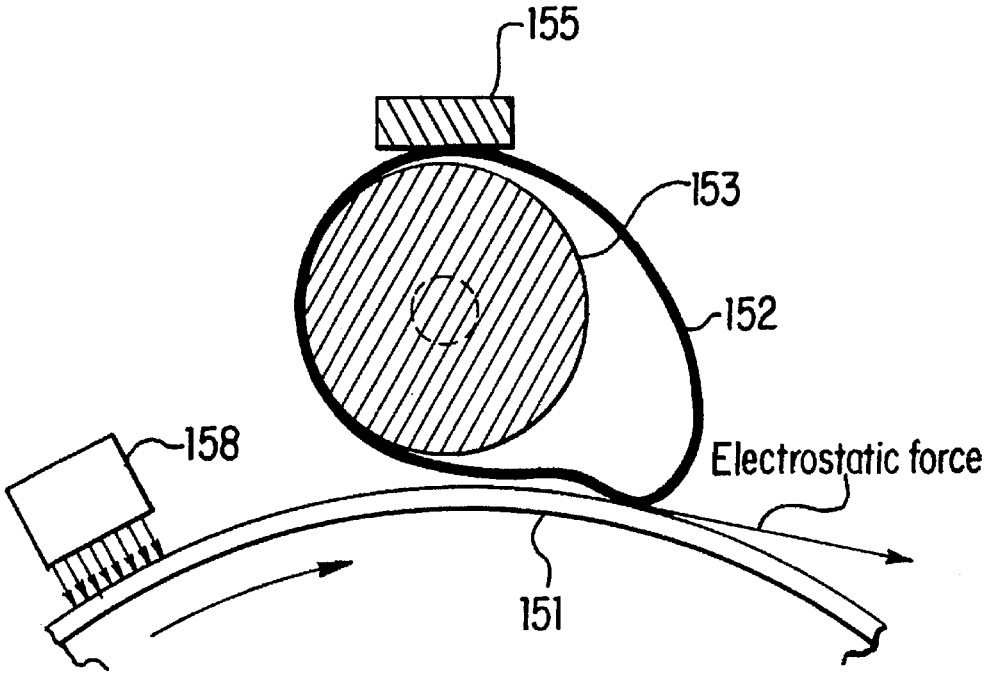
FIGS. 19(*a*) and 19(*b*) are a schematic sectional view and a schematic side view, respectively, of a modification of the image forming apparatus of FIG. 17.
Figure 19B:
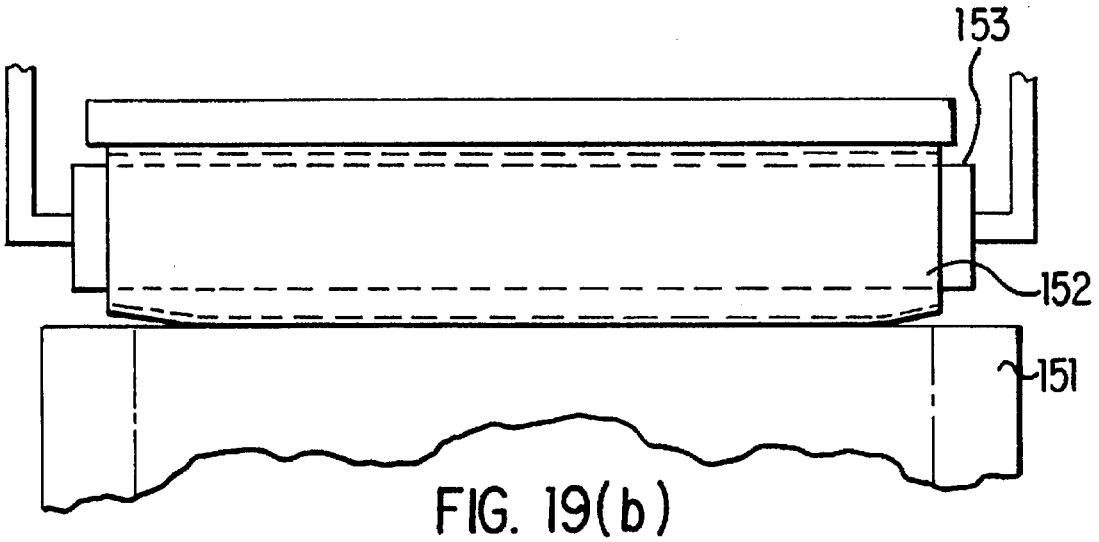

When a charging electrode 152 of a width smaller than that of the static eliminating lamp unit 158 is used in combination with a photoconductive drum 151 for comparison as shown in FIG. 19(*b*), the surface potential of the opposite side portions of the photoconductive drum 151 corresponding to the opposite side portions of the charging electrode 152 is about 0 V and hence the electrostatic force acting between the opposite side portions of the charging electrode 152 and the photoconductive drum 151 is comparatively high. Consequently, the opposite side portions of the charging electrode 152 are deformed greatly as shown in FIG. 19(*b*) and are in unstable contact with the photoconductive drum 151, so that the photoconductive drum 151 cannot be charged in a uniform potential distribution.

An image forming test operateion was carried out by using a 215 mm wide static eliminating lamp unit 158 and a 255 mm wide static eliminating lamp unit 158 to demonstrate the effect of this embodiment. Images free from defects could be formed when the 215 mm wide static eliminating lamp unit 158 was used, whereas images having transverse foggy defects in areas near the opposite side portions of the recording sheets were formed when the 255 mm wide static eliminating lamp unit 158 was used.

Figure 20A:
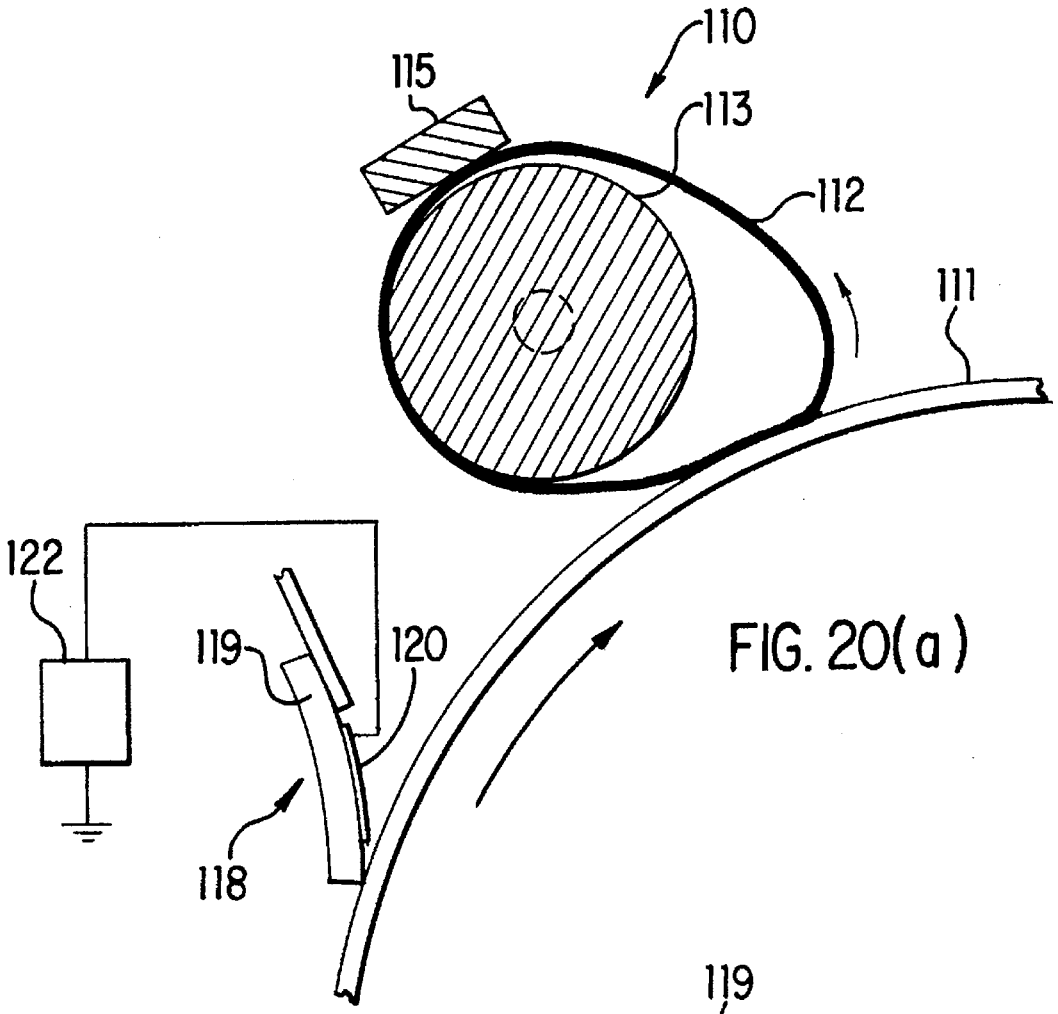
FIGS. 20(*a*) and 20(*b*) are schematic views of a charging device and a static eliminating device employed in an image forming apparatus in a seventh embodiment according to the present invention.
Figure 20B:
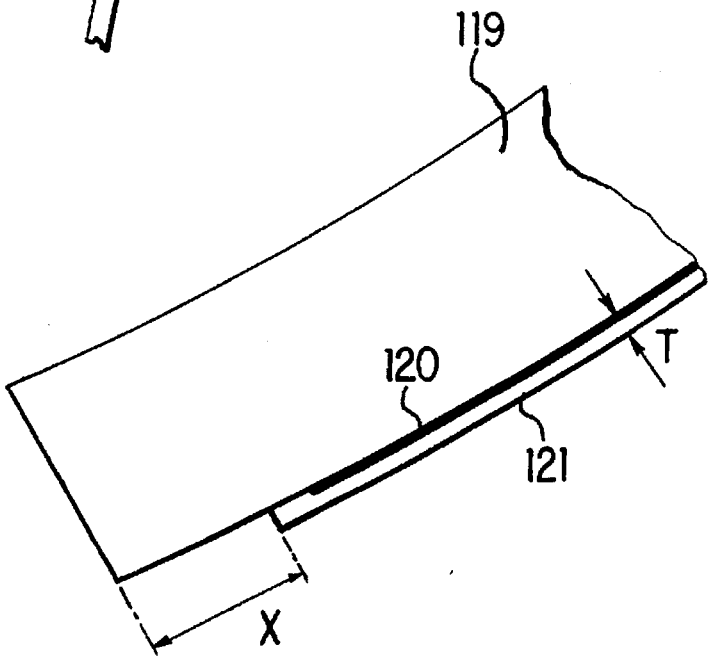

FIGS. 20(*a*) and 20(*b*) are schematic views of a charging device 110 and a discharging device 118 employed in an image forming apparatus in a seventh embodiment according to the present invention.

The charging device 110 is identical with the charging device 100 shown in FIGS. 17(*a*) and 17(*b*), and the discharging device 118 is different from the static eliminating lamp unit 108 shown in FIGS. 17(*a*) and 17(*b*).

The discharging device 118 comprises, as principal components, a cleaning blade 119 pressed against a photoconductive drum 111, a discharging electrode 120 attached to the surface of the cleaning blade 119 facing the photoconductive drum 111, a power supply 122 for applying a static eliminating voltage to the discharging electrode 120, and a resistance layer 121 overlying the discharging electrode 120 as shown in FIG. 20(*b*).

Since the cleaning blade 119 is pressed againstthe surface of the photoconductive drum 111, the discharging device 118 is capable of both removing residual toner from the surface of the photoconductive drum 111 and eliminating residual static charges from the surface of the photoconductive drum 111.

An eliminating voltage in the range of about 400 to 700 V, preferably, on the order of 600 V, is applied to the discharging electrode 120.

When a charging voltage of −350 V is applied to the charging electrode 112 of this image forming apparatus, the surface potential of the photoconductive drum 111 after the transference of an image from the photoconductive drum 111 to a recording sheet is in the range of about −250 to about −300 V in unexposed area, i.e., an area not exposed to exposure light emitted by the exposure device, and in the range of 0 to about −10 V in the exposed area, i.e., an area exposed to exposure light emitted by the exposure device. When the surface of the photoconductive drum 111 having such a potential distribution is exposed to light emitted by the discharging device 118, the potential difference between the photoconductive drum 111 and the discharging device 118 at the unexposed area becomes about 800 to 900 V, and the surface potential of the photoconductive drum 111 changes uniformly to about 0 V. The potential difference between the exposed area of the surface of the photoconductive drum 111 and the discharging electrode 120 becomes about 600 to about 700 V causing slight discharge between the exposed area and the discharging electrode 120, whereby the potential of the photoconductive drum 111 is adjusted substantially uniformly to 0 V.

Figure 21:
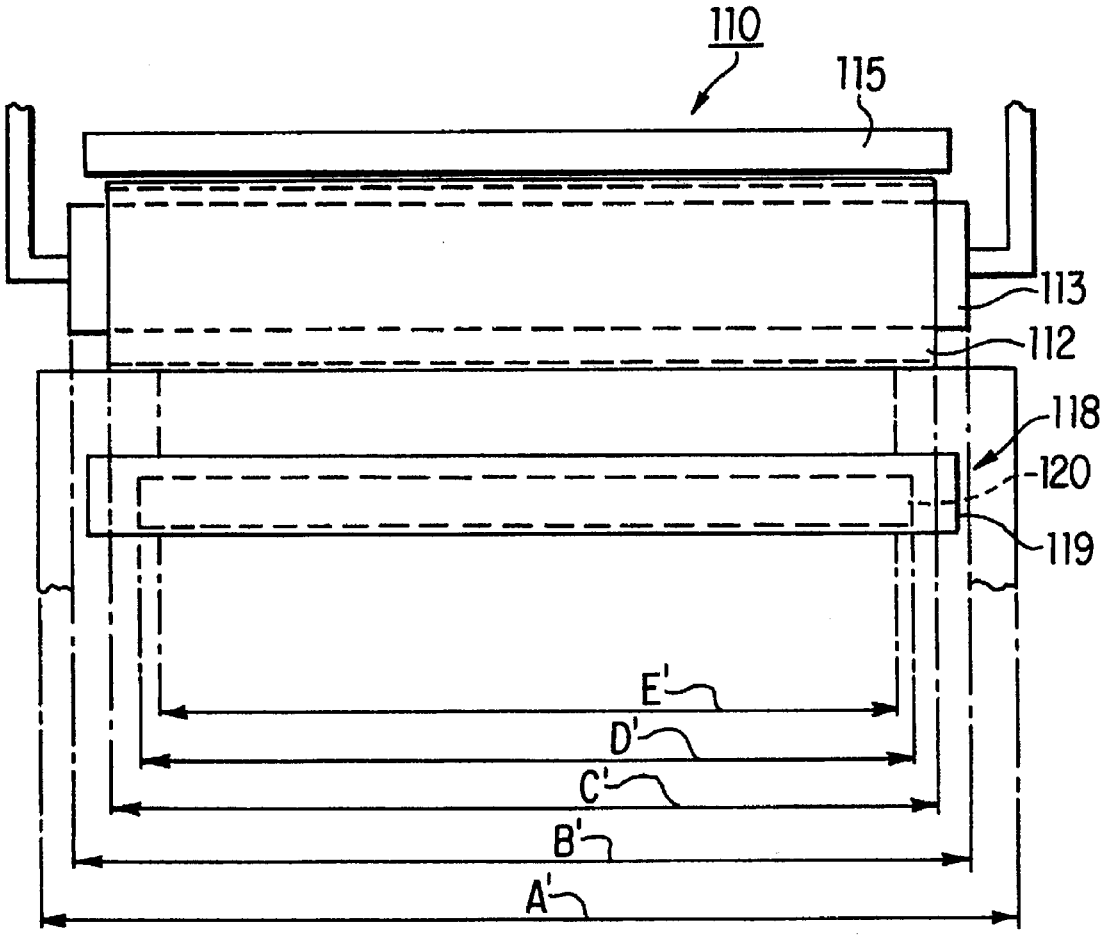
FIG. 21 is a side view of assistance in explaining the respective widths of the components of the image forming apparatus of FIG. 20.

In the image forming apparatus provided with the discharging device 118, the width A' of the photoconductive drum 111, the width B' of an electrode support member 113, the width C' of a charging electrode 112, the width D' of a discharging electrode 120 and the width E' of the image forming area of the photoconductive drum 111 are determined so as to meet an inequality: A'>B'>D'>D'>E' as shown in FIG. 21.

The following are the specifications of the image forming apparatus.

Cleaning blade 119: Urethane rubber blade

Discharging electrode 120:

Material: Paint containing carbon

Volume resistivity: $10^0$ Ω·cm

Resistance layer 121:

Material: Mixed paste of nylon and $SnO_2$

Volume resistivity: $10^6$ Ω·cm

Thickness T of the composite layer of discharging electrode 120 and resistance layer 121: 10 μm Distance X between the edge of cleaning blade 119 and the edge of resistance layer 120: 0.15 mm Voltage applied to discharging electrode 120: +600 V Widths of Component Parts (mm)

Photoconductive drum 111 (A'): 260

Electrode support member 113 (B'): 255

Charging electrode 112 (C'): 250

Discharging electrode 120 (D'): 215 (Comparative discharging electrode: 255)

Image forming area (E'): 210

In this image forming apparatus, the width D' of the discharging electrode 120 is smaller than the width C' of the charging electrode 112 and, the surface potential of the opposite side portions of the photoconductive drum 111 is in the range of about −250 to about −300 V and the surface potential of the middle portion of the photoconductive drum 111 exposed to the static eliminating light is about 0 V when the surface of the photoconductive drum 111 is subjected to the charging action of the charging electrode 112. When the surface potential of the photoconductive drum 101 is regulated as mentioned above, the electrostatic force acting between the middle portion of the charging electrode 112 and the photoconductive drum 111 is greater than that acting between the opposite side portions of the charging electrode 112 and the photoconductive drum 111. Consequently, the excessive deformation of the opposite side portions of the charging electrode 112 can be avoided and the charging electrode 112 and the photoconductive drum 111 are kept in uniform contact with respect to the axial direction. Therefore, the irregular charging of the photoconductive drum 111 and the formation of foggy defects in areas of an image near the opposite side portions of the recording sheet can be avoided.

The image forming test operation of the image forming apparatus proved that the image forming apparatus is capable of forming satisfactory images. When a discharging electrode having a width of 255 mm, which is greater than the width 250 mm of the charging electrode 112, was used for comparison, foggy stripes were formed in areas of an image near the opposite side portions of the recording sheet.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A charging device comprising:

a substantially cylindrical charging electrode formed by rolling a flexible, semiconductive film;

an electrode support member inserted in said substantially cylindrical charging electrode to support said charging electrode so as to be in contact with the turning surface of a charge acceptor; and a voltage applying means for applying a charging voltage to said charging electrode;

said electrode support member being held with a gap between said electrode support member and the charge acceptor so that said charging electrode can be turned by an electrostatic force acting between said charging electrode and the charge acceptor.

2. A charging device according to claim 1, wherein an electrode stabilizing member for stabilizing the turning of said charging electrode is disposed in contact with the outer surface of said charging electrode.

3. A charging device according to claim 2, wherein the shape of said electrode stabilizing member is determined so that the pressure applied by the opposite side portions of said electrode stabilizing member to the corresponding opposite side portions of said charging electrode to press the opposite side portions of said charging electrode toward the charge acceptor is greater than the pressure applied by the middle portion of said electrode stabilizing member to the corresponding middle portion of said charging electrode to press the corresponding middle portion of said charging electrode toward the charge acceptor.

4. A charging device according to claim 3, wherein the width along the turning direction of said charging electrode of the opposite side portions of said electrode stabilizing member in contact with the corresponding opposite side portions of said charging electrode is greater than that of the middle portion of the same in contact with the corresponding middle portion of said charging electrode.

5. A charging device according to claim 1, wherein the flexible, semiconductive film forming said charging electrode has a volume resistivity in the range of $1\times10^3$ to $1\times10^{10}$ Ω·cm.

6. A charging device according to claim 2, wherein the flexible, semiconductive film forming said charging electrode has a volume resistivity in the range of $1\times10^3$ to $1\times10^{10}$ Ω·cm.

7. A charging device according to claim 1, wherein the flexible, semiconductive film forming said charging electrode has a tensile modulus of elasticity as measured by a method specified in JIS K7127 in the range of 10 to 280 kg/mm2.

8. A charging device according to claim 2, wherein the flexible, semiconductive film forming said charging electrode has a tensile modulus of elasticity as measured by a method specified in JIS K7127 in the range of 10 to 280 $kg/mm^2$.

9. A charging device comprising:

a substantially cylindrical charging electrode formed by rolling a flexible, semiconductive film;

an electrode support member inserted in said substantially cylindrical charging electrode to support said charging electrode so as to be in contact with the turning surface of a charge acceptor;

a conductive electrode stabilizing member disposed in contact with the outer surface of said charging electrode to stabilize the turning of said charging electrode; and a voltage applying means for applying a charging voltage through said electrode stabilizing member to said charging electrode;

said electrode support member being held with a gap between said electrode support member and the charge acceptor so that said charging electrode can be turned by an electrostatic force acting between said charging electrode and the charge acceptor.

10. A charging device according to claim 9, wherein the shape of said electrode stabilizing member is determined so that the pressure applied by the opposite side portions of said electrode stabilizing member to the corresponding opposite side portions of said charging electrode to press the opposite side portions of said charging electrode toward the charge acceptor is greater than the pressure applied by the middle portion of said electrode stabilizing member to the corresponding middle portion of said charging electrode to press the corresponding middle portion of said charging electrode toward the charge acceptor.

11. A charging device according to claim 10, wherein the width along the turning direction of said charging electrode of the opposite side portions of said electrode stabilizing member in contact with the corresponding opposite side portions of said charging electrode is greater than that of the middle portion of the same in contact with the corresponding middle portion of said charging electrode.

12. A charging device according to claim 9, wherein the flexible, semiconductive film forming said charging electrode has a volume resistivity in the range of $1\times10^3$ to $1\times10^{10}$ Ω·cm.

13. A charging device according to claim 10, wherein the flexible semiconductive film forming the charging electrode has a volume resistivity in the range of $1\times10^3$ to $1\times10^{10}$ Ω·cm.

14. A charging device according to claim 9, wherein the flexible, semiconductive film forming said charging electrode has a tensile modulus of elasticity as measured by a method specified in JIS K7127 in the range of 10 to 280 kg/mm$^2$.

15. A charging device according to claim 10, wherein the flexible, semiconductive film forming said charging electrode has a tensile modulus of elasticity as measured by a method specified in JIS K7127 in the range of 10 to 280 kg/mm$^2$.

16. An image forming apparatus comprising:

a charge acceptor driven so that the circumference thereof turns;

charging means for charging said charge acceptor;

static eliminating means disposed before said charging means with respect to the moving direction of the circumference of said charge acceptor;

electrostatic latent image forming means for forming an electrostatic latent image represented by image information on said charge acceptor;

developing means for developing the electrostatic latent image in a visible image;

transfer means for transferring the visible image developed by said developing means to a recording medium; and fixing means for fixing the visible image to the recording medium;

said charging means comprising:

a substantially cylindrical charging electrode formed by rolling a flexible, semiconductive film;

an electrode support member inserted in said substantially cylindrical charging electrode to support said charging electrode so as to be in contact with the turning surface of said charge acceptor; and a voltage applying means for applying a charging voltage to said charging electrode;

said electrode support member being held with a gap between said electrode support member and said charge acceptor so that said charging electrode can be turned by an electrostatic force acting between said charging electrode and said charge acceptor.

17. An image forming apparatus according to claim 16, wherein said static eliminating means eliminates charges from said charge acceptor excluding those in portions of said charge acceptor with which the opposite side portions of said charging electrode are in contact.

18. An image forming apparatus according to claim 17, further comprising an electrode stabilizing member disposed so as to be in contact with the outer surface of said charging electrode to stabilize the turning motion of said charging electrode.

19. An image forming apparatus according to claim 18, wherein the shape of said electrode stabilizing member is determined so that the pressure applied by the opposite side portions of said electrode stabilizing member to the corresponding opposite side portions of said charging electrode to press the opposite side portions of said charging electrode toward said charge acceptor is greater than the pressure applied by the middle portion of said electrode stabilizing member to the corresponding middle portion of said charging electrode to press the corresponding middle portion of said charging electrode toward said charge acceptor.

* * * * *